US009799503B2

(12) United States Patent
Williams et al.

(10) Patent No.: US 9,799,503 B2
(45) Date of Patent: Oct. 24, 2017

(54) TRAVELING-WELL ION GUIDES AND RELATED SYSTEMS AND METHODS

(71) Applicant: Agilent Technologies, Inc., Santa Clara, CA (US)

(72) Inventors: Peter T. Williams, Santa Clara, CA (US); Guthrie Partridge, Santa Clara, CA (US); Noah Goldberg, Santa Clara, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 107 days.

(21) Appl. No.: 14/600,658

(22) Filed: Jan. 20, 2015

(65) Prior Publication Data

US 2016/0211128 A1 Jul. 21, 2016

(51) Int. Cl.
*H01J 49/06* (2006.01)

(52) U.S. Cl.
CPC ..... *H01J 49/063* (2013.01); *H01J 49/065* (2013.01)

(58) Field of Classification Search
CPC ..... H01J 49/066; H01J 49/065; H01J 49/062; H01J 49/067; H01J 49/06; H01J 49/0404
See application file for complete search history.

(56) References Cited

U.S. PATENT DOCUMENTS 6,107,628 A 8/2000 Smith et al.
8,981,287 B2 * 3/2015 Giles ..... H01J 49/062 250/281
2004/0026613 A1 * 2/2004 Bateman ..... H01J 49/062 250/281
2005/0023453 A1 * 2/2005 Bateman ..... H01J 49/4225 250/288
2009/0314935 A1 * 12/2009 Hoyes ..... H01J 49/4235 250/283
2014/0061457 A1 * 3/2014 Berdnikov ..... H01J 49/0095 250/281

FOREIGN PATENT DOCUMENTS

EP 1956635 A1 8/2008
WO 2012150351 A1 11/2012

OTHER PUBLICATIONS

Ryan T. Kelly et al., "The Ion Funnel: Theory, Implementations, and Applications", Mass Spectrometry Reviews, 2010, 29, 294-312.
Gyorgy Hars and Henk LC Meuzelaar, "Flexible ion conduit for use under rarefied atmospheric conditions", Rev. Sci. Instrum. 68 (9), Sep. 1997pp. 3351-3356.
Extended European Search Report dated Jun. 27, 2016 from related European Application No. 16152057.2.

* cited by examiner

*Primary Examiner* — David E Smith
*Assistant Examiner* — Hsien Tsai

(57) ABSTRACT

An ion guide generates a radio frequency (RF) field to radially confine ions to an ion beam along a guide axis as the ions are transmitted through the ion guide. The effective potential of the RF field has potential wells distributed along the guide axis. The RF field is constructed such that the potential wells move in an axial direction toward an exit end of the ion guide.

19 Claims, 15 Drawing Sheets

TRAVELING-WELL ION GUIDES AND RELATED SYSTEMS AND METHODS

TECHNICAL FIELD

The present invention relates to ion guides, including guides, conduits, funnels, collision cells, drift cells, and focusing devices, such as may be utilized in, for example, spectrometers such as mass spectrometers and ion mobility spectrometers.

BACKGROUND

A mass spectrometry (MS) system in general includes an ion source for ionizing molecules of a sample of interest, followed by one or more ion processing devices providing various functions, followed by a mass analyzer for separating ions based on their differing mass-to-charge ratios (or m/z ratios, or more simply "masses"), followed by an ion detector at which the mass-sorted ions arrive. An MS analysis produces a mass spectrum, which is a series of peaks indicative of the relative abundances of detected ions as a function of their m/z ratios.

An ion guide is an example of an ion processing device that is often positioned in the process flow between the ion source and the mass analyzer. An ion guide may serve to transport ions through one or more pressure-reducing stages that successively lower the gas pressure down to the very low operating pressure (high vacuum) of the analyzer portion of the system. For this purpose, the ion guide includes multiple electrodes that receive power from a radio frequency (RF) power source. The ion guide electrodes are arranged so as to inscribe an interior (volume) that extends along a central axis from an ion entrance to an ion exit, and has a cross-section in the plane transverse to the axis. The ion guide electrodes are further arranged so as to generate an RF electric field that confines the excursions of the ions in radial directions (in the transverse plane). By this configuration, the ions are focused as an ion beam along the central axis of the ion guide and are transported through the ion guide with minimal loss of ions. This may be done in the presence of a gas flow so as to filter neutral gas species such as neutral atoms or molecules from the ion beam. An ion guide may also serve to transport ions through one or more stages wherein the gas pressure is maintained at a substantially constant level, such as in an ion mobility drift chamber or an ion collision cell.

The interior of an ion guide may be filled with a gas such that the ion guide operates at a relatively high (yet still sub-atmospheric) pressure. For example, a gas filled ion guide may be positioned just downstream of the ion source to collect the as-produced ions with as few ion losses as possible. Also, a buffer gas may be introduced into an ion guide under conditions intended to thermalize (reduce the kinetic energy of) the ions, or to fragment the ions by collision induced dissociation (CID). At relatively high levels of vacuum, the motions of ions are relatively easy to control. On the other hand, at elevated pressures collisions with gas molecules increasingly dominate the behavior of ion motion, making ion transmission at high efficiency more challenging. See Kelly et al., The ion funnel: Theory, implementations, and applications, Mass Spectrom. Rev., 29: 294-312 (2010).

An ion funnel is a type of ion guide in which the ion guide volume surrounded by the electrodes converges in the direction of the ion exit. In a typical configuration, the funnel electrodes are arranged as a series of rings coaxial with the ion guide axis. The ring-shaped electrodes are stacked along the ion guide axis and spaced from each other by small axial gaps. The inside diameters of the ring-shaped electrodes are successively reduced in the direction of the ion exit, thus defining the converging ion guide volume. The ion funnel can be useful for a number of reasons. The RF field applied by the converging geometry can compress the ion beam and increase the efficiency of ion transmission through the funnel exit. The large beam acceptance provided by the funnel entrance can improve ion capture, and the comparatively small beam emittance at the funnel exit can improve ion transfer into a succeeding device and can be closely matched to the size of the inlet of the succeeding device. The ion funnel can operate more effectively at higher pressures than a straight cylindrical ion guide. Thus, for instance, the ion funnel is useful for collecting ions emitted from an ion source without being impaired by large gas flows that may occur in the upstream region of the MS system. Also, as the ring electrodes are distributed in the axial direction and are able to be individually coupled to direct current (DC) circuitry, the ring electrodes can be directly utilized to generate a DC gradient along the ion guide axis to assist in keeping ions moving forward.

However, the effective potential (or "pseudo-potential") of the RF field in ion funnels and other ion guides of stacked-ring geometry is non-zero on-axis (on the axis of symmetry). Instead, the effective potential forms a series of zeros or wells along the axis of symmetry. In practice, this is not much of a problem for higher-mass ions, but for low-mass ions these wells become problematic because they hinder the passage of the low-mass ions through the ion funnel. As a result, it is difficult to design an ion funnel that will work well for low-mass ions such as, for example, the lithium ion $Li^+$ (m/z=7) commonly encountered in inductively coupled plasma-mass spectrometry (ICP-MS).

Therefore, it would be desirable to provide ion guides, including ion funnels, which address the problem of impaired ion travel caused by potential wells.

SUMMARY

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one embodiment, an ion guide includes: an entrance end; an exit end at a distance from the entrance end along a guide axis; a plurality of electrodes surrounding a guide volume and axially spaced from each other along the guide axis from the entrance end to the exit end; and RF electronics configured for applying an RF drive signal to the electrodes effective for generating an RF field in the guide volume comprising a plurality of potential wells distributed along the guide axis, wherein the RF field comprises a waveform effective for moving the potential wells in at least one set of the electrodes in an axial direction toward the exit end.

According to another embodiment, a spectrometer includes: an ion guide according to any of the embodiments disclosed herein; and one or more of the following: an ion detector downstream from the ion guide, an ion source upstream of the ion guide, a mass analyzer downstream or upstream from the ion guide, an ion mobility drift cell downstream or upstream from the ion guide, an ion mobility drift cell comprising the ion guide, and/or an RF voltage source configured for applying an RF voltage to the electrodes effective for generating the RF field.

According to another embodiment, a method for guiding ions includes: transmitting ions through an ion guide comprising an entrance end, an exit end at a distance from the entrance end along a guide axis, and a plurality of electrodes surrounding a guide volume and axially spaced from each other along the guide axis from the entrance end to the exit end; and while transmitting the ions, applying an RF field to the ions comprising a plurality of potential wells distributed along the guide axis, wherein the RF field is applied by applying an RF drive signal to the electrodes that comprises a waveform effective for moving the potential wells in at least one set of the electrodes in an axial direction toward the exit end.

According to another embodiment, a mass spectrometer (MS) is configured for performing any of the methods disclosed herein.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
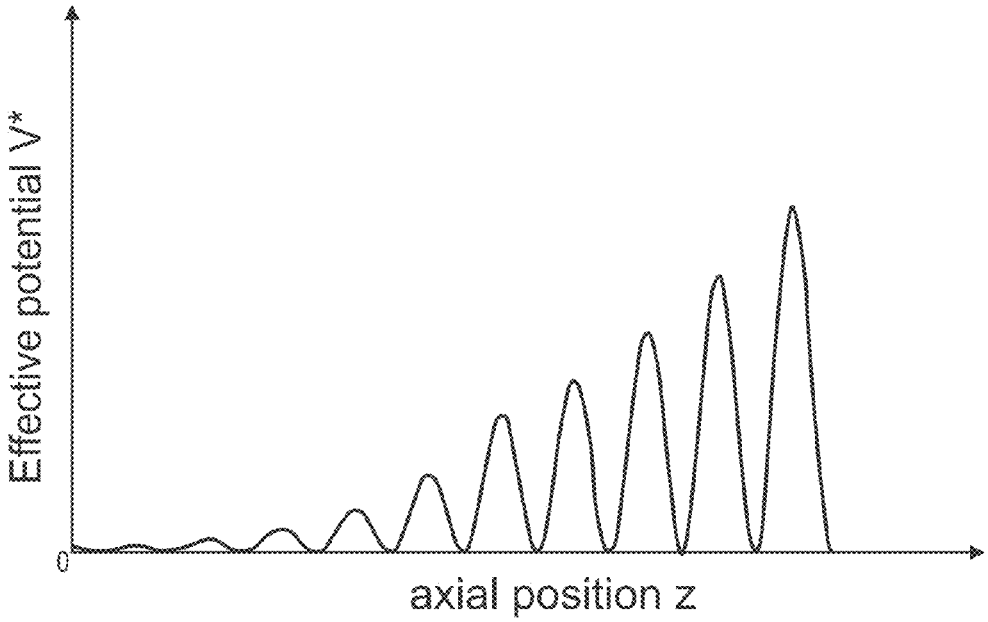
FIG. 1 is a plot of effective potential in a conical ion funnel on axis (r=0 mm) as a function of axial position z.

As noted above, in a conventional ion funnel the effective potential (also known as quasi-potential or pseudo-potential) of the radio frequency (RF) field utilized to radially confine ions is not zero, but rather forms a series of potential wells along the central axis of the ion funnel. To illustrate an example of axially distributed potential wells, FIG. 1 is a plot of effective potential in a conical ion funnel on axis (r=0 mm) as a function of axial position z. In a converging ion funnel, the depth of the potential wells increases in the direction of the convergence, as shown.

At sufficiently high RF frequency $f=\omega/2\pi$, ions in vacuum undergo harmonic oscillations superposed on longer-term secular motion. The secular motion can be found using an effective potential V* (in volts):

$$V^* = (m/z)^{-1}\frac{e|E|^2}{4\omega^2}, \tag{1.1}$$

where m/z is the mass-to-charge ratio of an ion, e is elementary charge (in coulombs), E is the magnitude (strength) of the local RF electric field (in V/m), and ω is the RF angular frequency (in radians per second), i.e., $\omega=2\pi f$ where f is the RF frequency. It will be noted that in the presence of gas, such as in a high-pressure ion funnel, this motion is damped and/or has a stochastic component to it. Consequently, the depth of effective potential wells should be compared with, among other things, the thermal energy $k_B T_{gas}$ ($k_B$=Boltzmann's constant, $T_{gas}$=gas temperature) and the energy gained between collisions.

Figure 2:
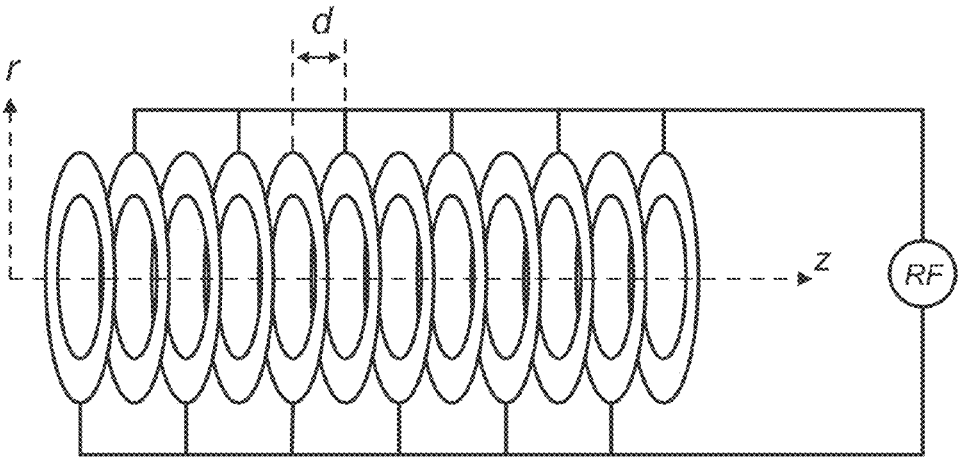
FIG. 2 is a schematic view of an ion guide having a known stacked-ring configuration.

The origin of the on-axis wells in the effective potential may be understood by considering an ion guide of stacked-ring configuration, as shown in FIG. 2, reproduced from above-referenced Kelly et al. (2010). The stacked-ring ion guide, from which the ion funnel is derived, includes a series of ring-shaped electrodes separated by an axial spacing d. As illustrated, the RF drive voltage is applied to each electrode is 180 degrees out-of-phase with the electrodes adjacent to that electrode. The effective potential for the stacked-ring ion guide may be expressed as:

$$V^*(R,z)=V_{trap}[I_1^2(\tilde{R})\cos^2\tilde{z}+I_0^2(\tilde{R})\sin^2\tilde{z}], \tag{1.2}$$

where $\tilde{R}=\pi R/\delta$, δ is the plate (or ring) spacing, $\tilde{z}=\pi z/\delta$, and $I_0$ and $I_1$ are modified Bessel functions. The coefficient $V_{trap}$ is the axial effective potential well depth and depends on the RF voltage magnitude and frequency, the plate spacing δ, and the diameter of the ring electrodes.

Figure 3:
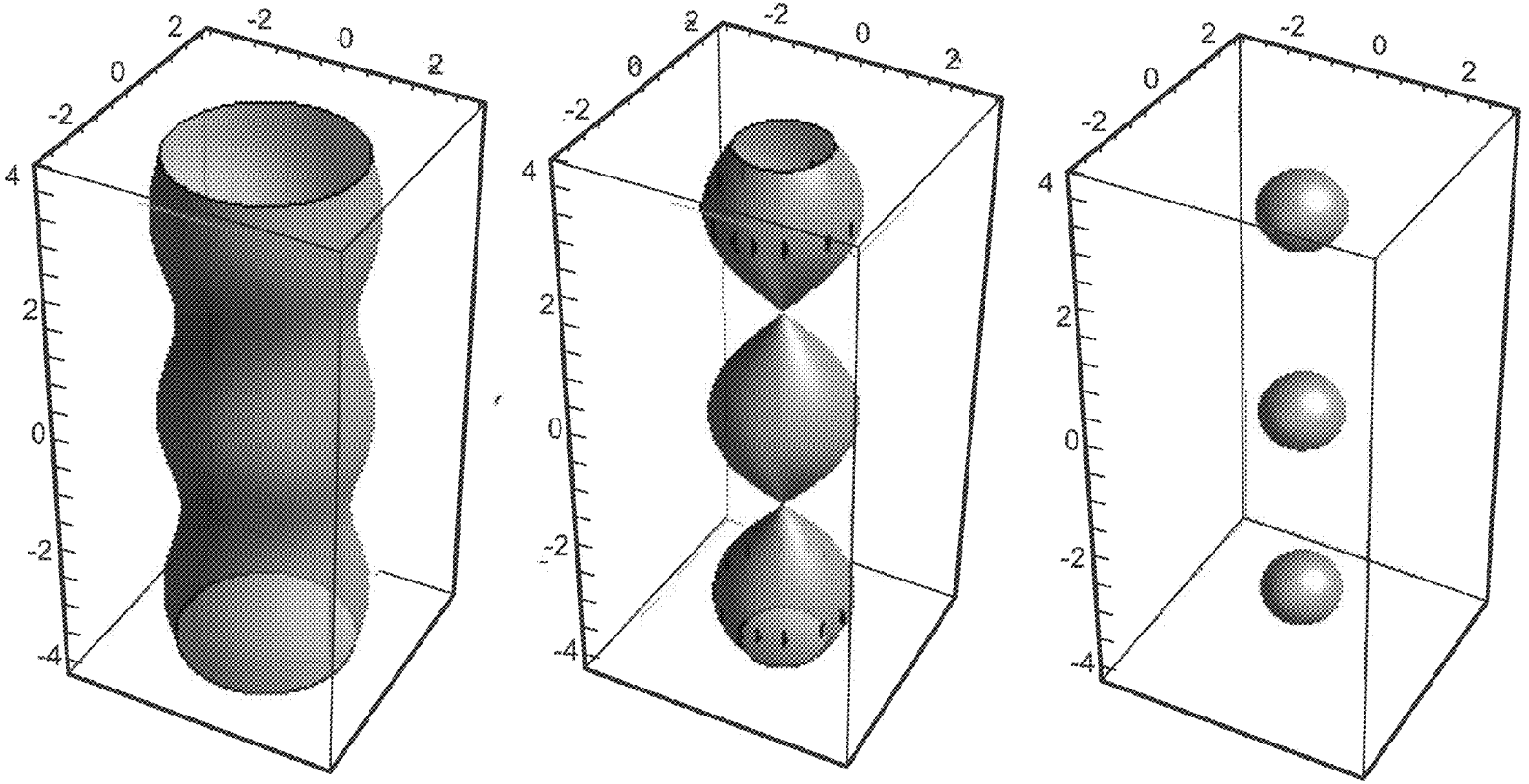
FIG. 3 is a set of representations of the wells of effective potential of an ion funnel, showing iso-potential surfaces for three different values of the effective potential or quasi-potential V*, generated by modeling software.

FIG. 3 is a set of representations of the wells of effective potential of a stacked-ring ion guide, showing iso-potential surfaces for three different values of V*, generated by modeling software. The axis of symmetry of the guide is oriented from top to bottom instead of left to right.

It becomes evident that Equation 1.2 does not describe the full effective potential for the stacked-ring configuration, but instead is just the lowest-order approximation to the effective potential at small scaled radii $\tilde{R}$. With this in mind (and noting that because this is a quasi-electrostatic problem, the potential is complex instead of real), it is assumed the RF field potential V can be written as:

$$V(R,\theta,z)e^{-i\omega t}. \tag{1.3}$$

Assuming axisymmetry and that $V \propto \cos(\tilde{z})$ for some scaled z, then solving the Laplace equation and scaling R by the same factor as z, the potential V can be expressed as:

$$V(R,\theta,z)=V_0 I_0(\tilde{R})\cos\tilde{z}. \quad (1.4)$$

That is, the potential V is proportional to the $0^{th}$ modified Bessel function, up to some proportionality constant $V_0$. From Equation 1.1 the functional form of Equation 1.2 is easily found, recalling that:

$$\frac{d}{dx} I_0(x) = I_1(x). \quad (1.5)$$

Figure 4:
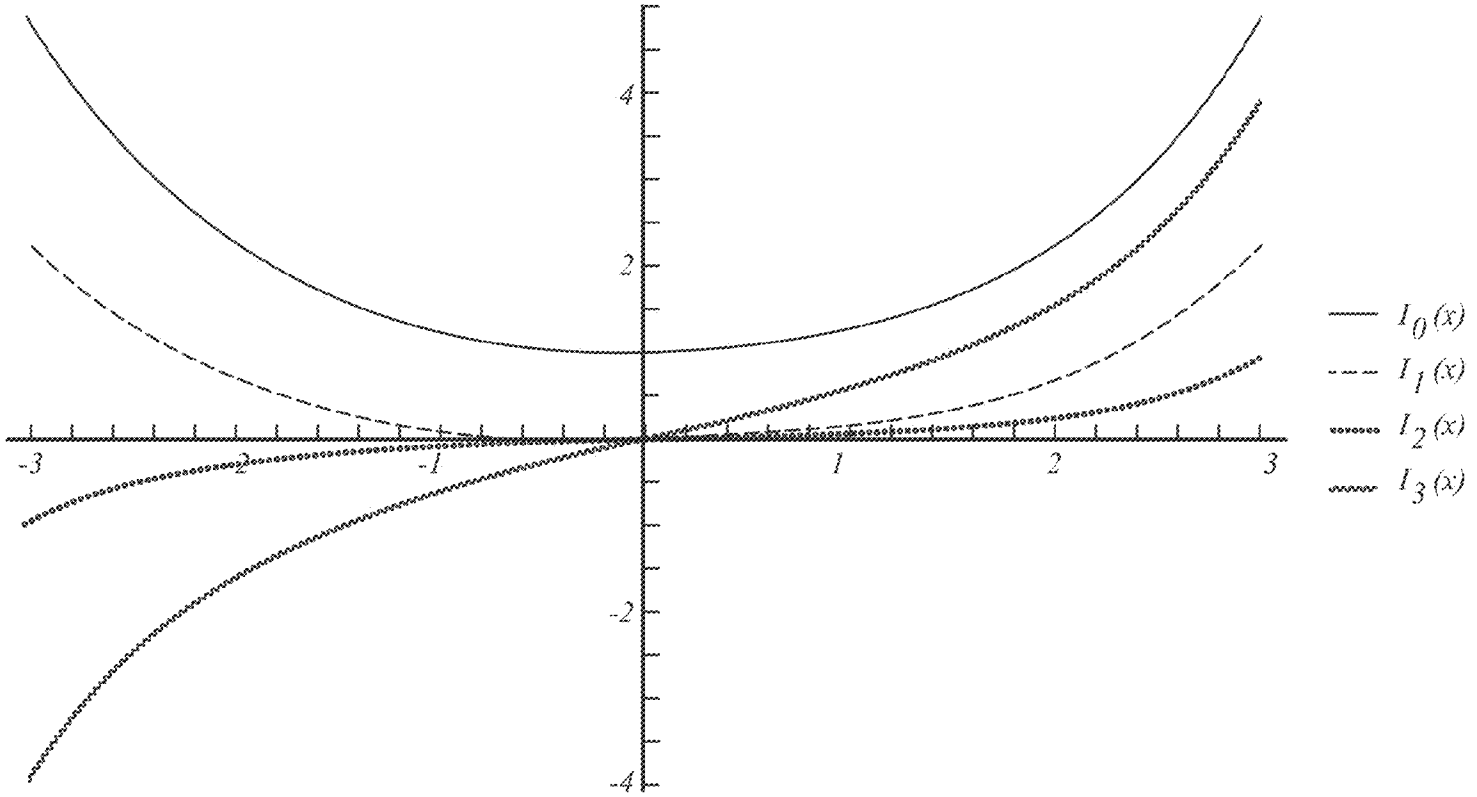
FIG. 4 is a set of plots of the first four modified Bessel functions, starting with the $0^{th}$ modified Bessel function.
Figure 5:
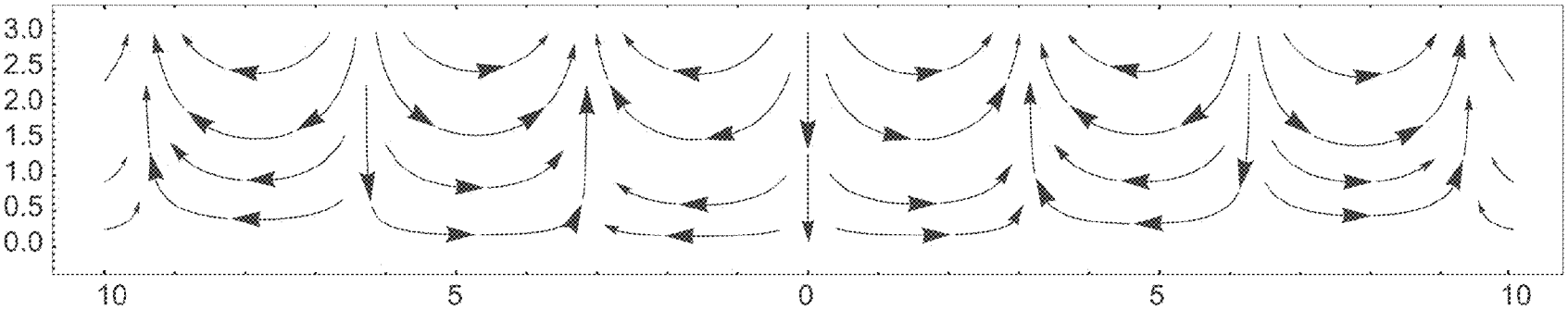
FIG. 5 is a plot of the electric field vectors for the lowest-order approximation to a cylindrical straight section of the ion funnel, corresponding to Equation 1.4 set forth below, as viewed in a plane perpendicular to the axis of symmetry.
Figure 6:
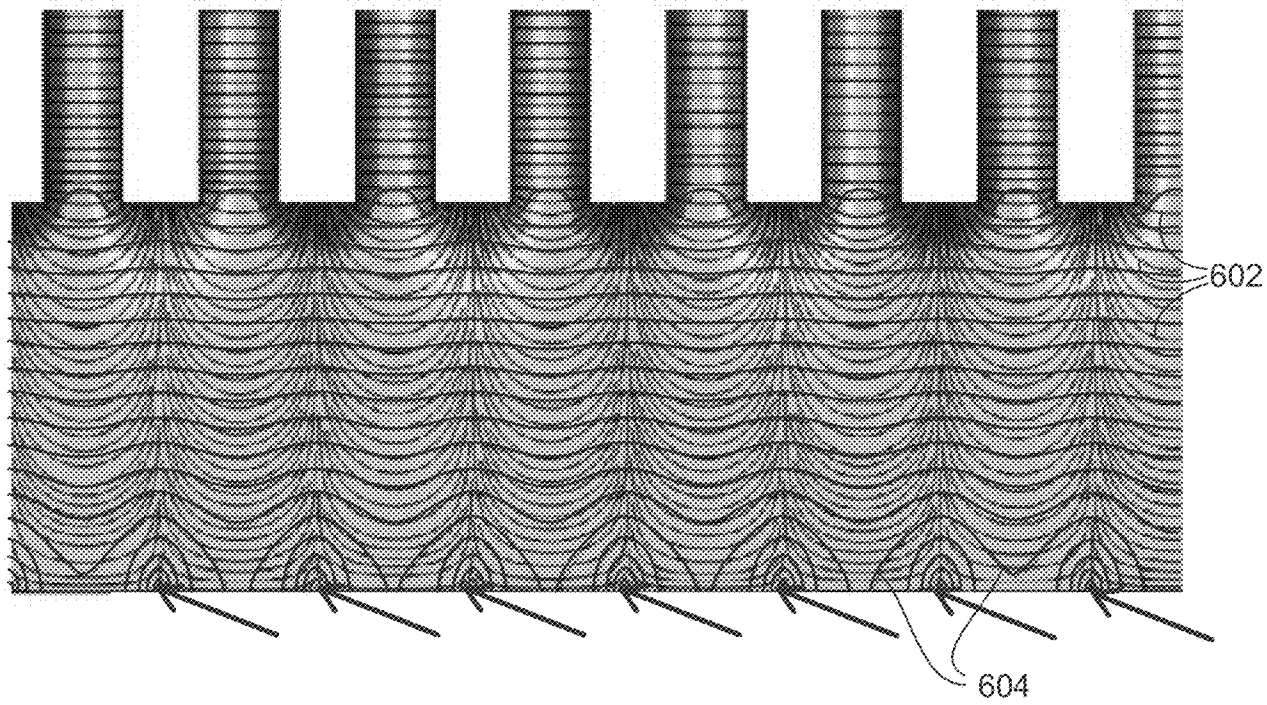
FIG. 6 shows a simulated RF field of the straight section of an ion funnel.

From the foregoing, it becomes evident that the effective potential does not go to zero uniformly along the axis R=0 because the $0^{th}$ modified Bessel function $I_0$, unlike $I_1$, $I_2$, $I_3$ et seq., does not go to zero on the axis R=0. This is illustrated in FIG. 4, which is a set of plots of the first four modified Bessel functions $I_0(x)$, $I_1(x)$, $I_2(x)$, and $I_3(x)$. This is an inevitable consequence of Gauss's law and the fact that alternating potentials are applied to the plates. The result is that even on-axis, the electric field never goes to zero except at a few isolated discrete locations, which are the zeros of the effective potential. This is further illustrated in FIG. 5, which shows the electric field vectors for the lowest-order approximation to the ion funnel, corresponding to Equation 1.4. The axis is oriented right-to-left. This is also illustrated in FIG. 6, which shows a simulated RF field of the straight section of a realistic ion funnel. Specifically, FIG. 6 shows a portion of the cross-section of the ring-shaped electrodes, and the upper half of the volume surrounded by the electrodes (from the axis of symmetry at the bottom of FIG. 6, and radially upward to the inside surfaces of the electrodes that define their inside diameters). The shading indicates the strength of the quasi-electrostatic (RF) potential. FIG. 6 also shows electric field lines 602, and contours 604 of effective potential per Equation 1.1. The arrows in FIG. 6 point to wells of the effective potential along the axis of symmetry of the funnel.

According to an aspect of the present disclosure, the problem regarding the potential wells in straight ion guides and converging ion guides (ion funnels) of stacked-ring configuration is addressed by generating an RF field in which the potential wells move in the axial direction toward the ion exit of the ion guide, i.e., in the positive axial (+z) direction. By such a configuration all ions, including lower-mass ions that might otherwise become trapped in the potential wells, may be successfully moved forward through the ion guide and transferred out from the ion exit.

Figure 7:
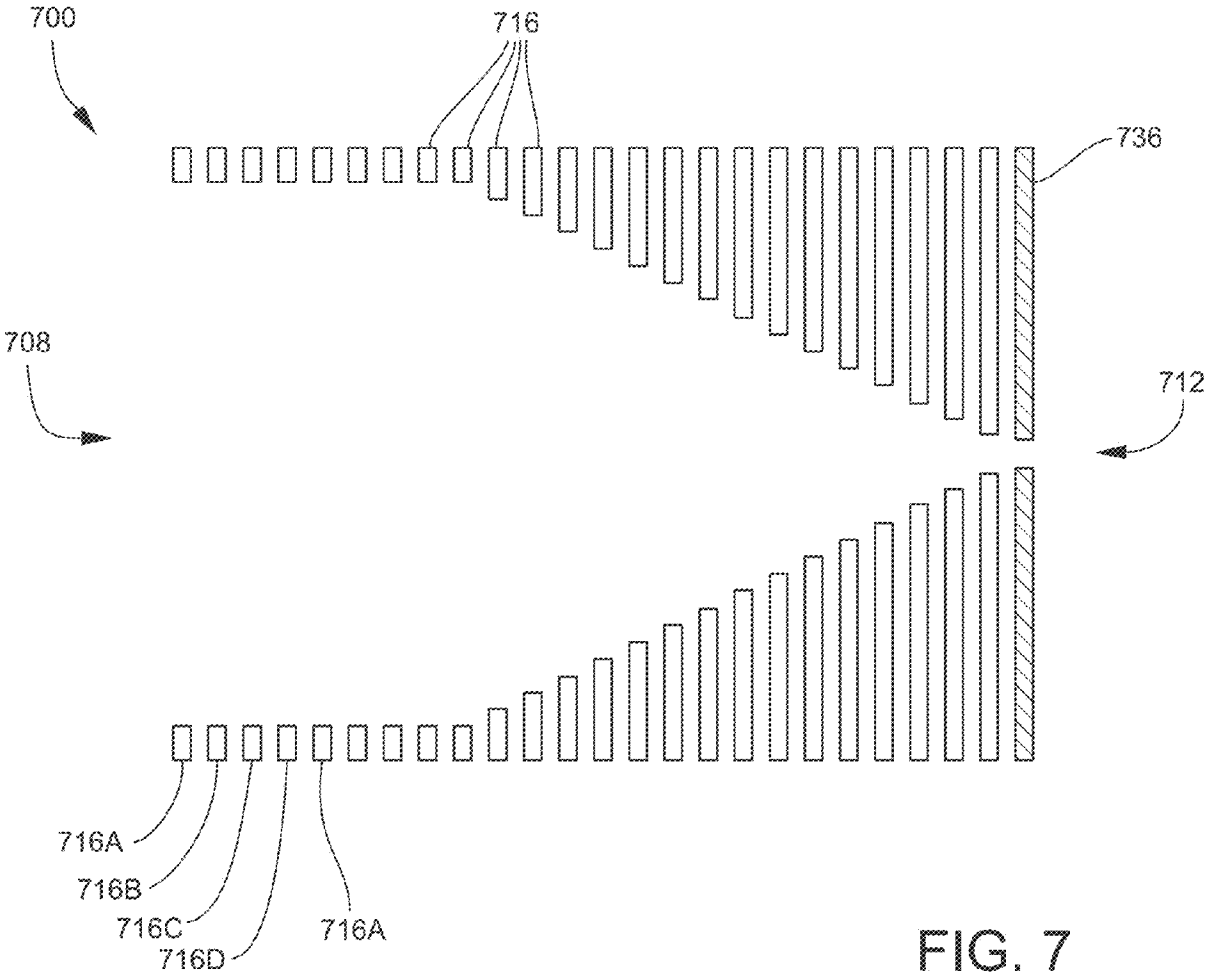
FIG. 7 is a schematic view of an example of an ion guide according to some embodiments.

FIG. 7 is a schematic view of an example of an ion guide 700 according to some embodiments. In the context of the present disclosure, the term "ion guide" generally encompasses any device configured for constraining ion motion such that ions primarily occupy a region along the axis of the ion guide as a cloud or beam. The term "ion guide" may encompass any one of specific classes of ion guides such as funnels, straight conduits, and other ion focusing devices.

The ion guide 700 generally has a length along a longitudinal axis (or the "ion guide axis"), and a transverse cross-section in the transverse plane orthogonal to the ion guide axis. The geometry of the ion guide 700 generally may be symmetrical about the ion guide axis, in which case the ion guide axis may be considered to be a central axis or axis of symmetry. For reference purposes, FIG. 7 provides a Cartesian coordinate system in which the z-axis corresponds to the ion guide axis whereby the cross-section of the ion guide 700 lies in the transverse x-y plane. From the perspective of FIG. 7, resultant ion travel is directed from the left to the right generally along the ion guide axis which may be considered as the ion optical axis.

The ion guide 700 generally includes an ion entrance end 708, an ion exit end 712 disposed at a distance from the ion entrance end 708 along the ion guide axis, and a plurality of ion guide electrodes 716 surrounding the guide axis and thereby surrounding an ion guide volume extending from the ion entrance end 708 to the ion exit end 712. In practice, a housing (not shown) encloses the ion guide 700 to provide a pressure-controlled operating environment. Ions are received at the ion entrance end 708 from an upstream device such as, for example, an ion source, an upstream ion guide, an ion trap, a mass filter, an ion fragmentation device, an ion mobility (IM) drift cell, etc. For this purpose, a gas conductance limiting aperture (e.g., a skimmer plate) may be positioned on the ion guide axis just upstream of the ion entrance end 708 which assists in preventing unwanted neutral molecules from entering the ion guide 700 as appreciated by persons skilled in the art. Ion optics may also positioned upstream of the ion entrance end 708 to assist in transferring ions into the ion entrance end 708. Ions are emitted from the ion exit end 712 into a downstream device such as, for example, a downstream ion guide, an ion trap, a mass filter, an ion fragmentation device, an ion beam cooler, an IM drift cell, a mass analyzer, etc. For this purpose, the ion exit end 712 may likewise include a gas conductance limiting aperture on the ion guide axis and may further include associated ion optics.

The ion guide 700 is configured for radially confining ions to an ion beam concentrated along the ion guide axis. That is, the ion guide 700 is configured for constraining the motions of the ions in the radial directions (in the transverse, x-y plane in FIG. 7) while allowing the ions to flow axially through the ion guide 700. In some embodiments, the ion guide 700 may also be configured for axially accelerating the ions as they travel through the ion guide 700 to prevent stalling and/or, in further embodiments, to facilitate ion fragmentation. Alternatively or additionally, ion optics positioned at (at or proximate to) the ion entrance end 708 and the ion exit end 712 may be configured for this purpose. In some embodiments, the ion guide 700 may be configured for reducing the kinetic energy of the ions, i.e., cooling or "thermalizing" the ions, in which case an inert buffer gas (e.g., nitrogen, argon, etc.) may be utilized in the ion guide 700. In some embodiments entailing tandem mass spectrometry, the ion guide 700 may be configured for fragmenting the (precursor, or "parent") ions to produce fragment (product, or "daughter") ions, in which case an inert buffer gas (e.g., nitrogen, argon, etc.) may be utilized in the ion guide 700 at a pressure appropriate for collision induced dissociation (CID). In some embodiments entailing IM spectrometry, the ion guide 700 may be configured for use as an ion mobility drift cell, in which case an inert buffer gas may be utilized in the ion guide 700 at a pressure and temperature appropriate for measuring ion drift time through the ion guide 700.

To radially confine ions, the ion guide electrodes 716 are configured for generating a two-dimensional (in the transverse, x-y plane in FIG. 8A) RF radial confining field. According to an aspect of the present disclosure, the potential wells of the RF field travel in the positive axial direction, as described further below. In some embodiments, the ion guide electrodes 716 have a stacked-ring configuration. Specifically, the ion guide electrodes 716 are ring-shaped in the transverse plane and surround the ion guide axis, and are axially spaced from each other along the ion guide axis. Thus, each ion guide electrode 716 is spaced from an adjacent ion guide electrode 716 by an axial gap between the two ion guide electrodes 716. The ion guide electrodes 716 may be precisely fixed in position in the ion guide 700 utilizing appropriate mounting hardware such as electrically insulating mounting features.

The ion guide 700 also includes an RF voltage source configured for applying an RF voltage of desired parameters (RF drive frequency $f=\omega/2\pi$, amplitude $V_{RF}$, and phase $\phi$) to generate the RF radial confining field along the length of the ion guide 700. The RF voltage source communicates with each ion guide electrode 716 via suitable circuitry as appreciated by persons skilled in the art. That is, each ion guide electrode 716 is independently addressable by the RF voltage source.

The ion guide 700 may also include a DC voltage source communicating with the ion guide electrodes 716. The DC voltage source may apply a DC voltage $V_{DC}$ to the ion guide electrodes 716 in a manner that generates an axial DC potential gradient, thereby ensuring that ions continue to drift in the forward direction, even after losing kinetic energy to multiple collisions with a buffer gas when utilized in some embodiments.

In some embodiments, the ion guide 700 may be surrounded by an electrically conductive shroud (not shown) to which a DC voltage may be applied. The conductive shroud may be a solid cylindrical wall, or a cylindrical wall having a pattern of holes to facilitate gas flow, or a mesh. The conductive shroud may be shaped as a straight cylinder, or as a cone with a taper angle (angle of convergence) being the same or different as that defined by the arrangement of ion guide electrodes 716.

FIG. 7 further illustrates a DC-only conductance limiting aperture 736 (a plate with an aperture on-axis) positioned at the ion exit end 712 after the final ion guide electrode 716. The inside diameter of the conductance limiting aperture 736 may be less than that of the final ion guide electrode 716.

In the illustrated embodiment, the ion guide 700 includes a cylindrical section that transitions to a funnel section (or converging section). In the cylindrical section, the respective inside diameters of the ion guide electrodes 716 remain constant (or substantially constant) along the guide axis from the ion entrance end 708 to the ion exit end 712. The cylindrical section of the ion guide 700 may be referred to herein as an ion "conduit." In the funnel section, the respective inside diameters of the ion guide electrodes 716 are successively reduced along the guide axis in the direction toward the ion exit end 712, such that the guide volume surrounded by the ion guide electrodes 716 in the funnel section converges in a direction toward the ion exit end 712. The funnel section is useful for concentrating the ion beam, i.e., converging the volume occupied by the ion phase space. By this configuration, the ion beam has a relatively large beam acceptance (admittance) at the entrance end of the funnel section that maximizes ion collection from the preceding ion processing device, and has a relatively small beam emittance at the exit end of the funnel section that maximizes ion transmission into the succeeding ion processing device. As a result, the ion guide 700 is configured for transmitting ions through the ion guide 700 in a manner that minimizes loss of ions.

In other embodiments, the ion guide 700 may include more than one cylindrical section and/or funnel section. In other embodiments, the ion guide 700 may include a diverging section. In other embodiments, the ion guide 700 may include only a cylindrical section (i.e., the ion guide 700 may be an ion conduit), or may include only a funnel section. In some embodiments the ion guide is constructed to allow neutral species such as gas atoms and molecules to escape radially, thus filtering out neutral species from the ion beam.

In FIG. 7, the ion guide electrodes 716 are depicted as being plates with apertures on-axis and uniform (or substantially uniform) outer dimensions (e.g., perimeters). The perimeters, or outer edges, of the ion guide electrodes 716 may rounded (circular or elliptical) or polygonal (e.g., square or rectangular). In other embodiments, the ion guide electrodes 716 may ring or hoop shaped, in which case ion guide electrodes 716 with varying aperture sizes (inside diameters) in a funnel section will likewise have varying outside diameters.

In some embodiments, the total number of ion guide electrodes 716 utilized in the ion guide 700 may be larger, and the axial spacing between the ion guide electrodes 716 may be smaller, than is typical for a conventional ion guide of stacked-ring geometry. As one non-limiting example, the total number of ion guide electrodes 716 may be doubled and the axial spacing may be halved. In some embodiments, the axial spacing may be in a range from 0.5 mm to 2.0 mm.

In operation, while transmitting ions through the ion guide 700, an RF field is applied to the ions by applying RF drive signals to the ion guide electrodes 716. Due to the stacked-ring geometry of the ion guide electrodes 716, the RF field generated in the ion guide volume has a plurality of potential wells distributed along the guide axis. According to the present disclosure, the ion guide electrodes 716 are electrically driven so as to create traveling potential wells in the effective potential of the RF field. That is, the potential wells move in the positive axial direction (toward the exit end) at a certain speed, which may depend on the axial spacing between the ion guide electrodes 716 and the frequency composition of the applied RF field. This may be accomplished by applying one or more RF drive signals to the ion guide electrodes 716 that comprise one or more periodic waveforms effective for moving the potential wells.

In some embodiments, the ion guide electrodes 716 may be (at least conceptually) divided into an axial series of electrode groups or sets that begin at the ion entrance end 708 and terminate at the ion exit end 712, with each electrode set containing the same number N of electrodes as the other electrode sets. In some embodiments, N=3 or greater. The traveling potential wells are realized by applying a repeating sequence of different RF waveforms (RF drive signals having different waveforms) to successive sets of the ion guide electrodes 716. In this case, the RF drive signal applied to the ion guide electrodes 716 comprises N different RF drive signals respectively comprising N different waveforms. Each of the N different waveforms has at least one parameter whose value differs from the value of the parameter of the other waveforms. Generally, the parameter may be any parameter that, when varied from one ion guide electrode 716 to the next, results in the traveling well operation. In some embodiments, the parameter that distinguishes the N different waveforms from each other is phase. The N different RF drive signals are applied to the respective N electrodes of each electrode set, wherein the sequence in which the N different RF drive signals are applied may be repeated from one electrode set to the next electrode set.

The N different waveforms may be constructed, and addressed to selected ion guide electrodes 716 in each electrode set, so as to control or manipulate the time domain of the effective potential in a manner that results in advancing the potential wells in the axial direction.

In some embodiments, for a given sequence of N ion guide electrodes 716, the N different RF waveforms have the form $V_i\ F(\omega_m t-\phi_i)\ \exp(j\omega t)$, where $V_i$ is a zero-to-peak amplitude, F is a complex function of its argument and is periodic with period $2\pi$, $\omega$ and $\phi_m$ are scalars, t is time, $\phi_i$ is a phase, j is an imaginary unit, and i is an integer from 1 to N, and it is understood that the applied voltage is the real part of this complex expression. The scalar quantities $\omega$ and $\omega_m$ may be angular frequencies in rad/s, with $\omega$ being a high frequency and $\omega_m$ being a relatively low frequency (e.g., $\omega_m$ may be substantially less than $\omega$). The value of the phase $\phi_i$ differs for each of the N different RF waveforms (i.e., the phase of the waveform applied to a given ion guide electrode 716 is shifted relative to the phase of the waveform applied to the preceding ion guide electrode 716) in a manner that creates the traveling wave phenomenon. The amplitude $V_i$ may be a complex amplitude. As indicated, the amplitude $V_i$ may vary from one ion guide electrode 716 to another. Alternatively, a common amplitude ($V_0$) may be applied all ion guide electrodes 716 of a given sequence.

As one non-limiting example, N=4, i.e., each electrode set contains four ion guide electrodes 716. That is, the N electrodes in each electrode set comprise, in sequence, a first electrode 716A, a second electrode 716B, a third electrode 716C, and a fourth electrode 716D. As illustrated in FIG. 7, the sequence is the same in each electrode set and may be repeated over the entire axial length of the ion guide 800 from the ion entrance end 708 to the ion exit end 712 (i.e., A, B, C, D, A, B, C, D, A, . . . ). Thus, the fourth electrode 716D in each electrode set is followed by the first electrode 716A of the next succeeding electrode set. In this example, four different RF drive signals are respectively applied to the four ion guide electrodes 716 of each electrode set. That is, a first RF drive voltage is applied to the first electrodes 716A, a second RF drive voltage is applied to the second electrodes 716B, a third RF drive voltage is applied to the third electrodes 716C, and a fourth RF drive voltage is applied to the fourth electrodes 716D.

Continuing with the example of four ion guide electrodes 716 in each electrode set, in some embodiments the four RF drive signals respectively applied to the first electrode 716A, second electrode 716B, third electrode 716C, and fourth electrode 716D may have the following waveforms:

$$V_A=V_1F(\omega_m t-\phi_1)\exp(j\omega t),\qquad \text{First RF drive signal:}$$

$$V_B=V_2F(\omega_m t-\phi_2)\exp(j\omega t),\qquad \text{Second RF drive signal:}$$

$$V_C=V_3F(\omega_m t-\phi_3)\exp(j\omega t),\ \text{and}\qquad \text{Third RF drive signal:}$$

$$V_D=V_4F(\omega_m t-\phi_4)\exp(j\omega t),\qquad \text{Fourth RF drive signal:}$$

where $\phi_1$ is a first phase, $\phi_2$ is a second phase shifted 90 degrees ($\pi/2$ rads) relative to the first phase, $\phi_3$ is a third phase shifted 180 degrees ($\pi$ rads) relative to the first phase, and $\phi_4$ is a fourth phase shifted 270 degrees ($3\pi/2$ rads) relative to the first phase. That is, each succeeding waveform in the sequence is shifted 90 degrees ($\pi/2$ rads) from the preceding waveform, and all the phase shifts through the sequence occur in the same sense (or angular direction).

In other examples, for N=5 ion guide electrodes 716, the RF potential applied to each succeeding electrode may be shifted 72 degrees from the preceding electrode; for N=6 ion guide electrodes 716, the RF potential applied to each succeeding electrode may be shifted 60 degrees from the preceding electrode; etc.

Generally, the different RF drive signals applied to the ion guide electrodes 716 may be generated by any appropriate technique and electronics known to or later developed by persons skilled in the art. For example, RF transmitting circuitry placed in electrical communication with the ion guide electrodes 716 may include a stable RF energy source, an RF frequency synthesizer (waveform generator) to produce an RF source signal (or main RF signal), a modulator (e.g., local oscillator, pulse programmer, etc.) for configuring the RF source signal according to desired parameters (e.g., amplitude, phase, shape, pulse width, etc.), a signal amplifier for scaling up the waveform(s), etc., as appreciated by persons skilled in the art.

Figure 8:
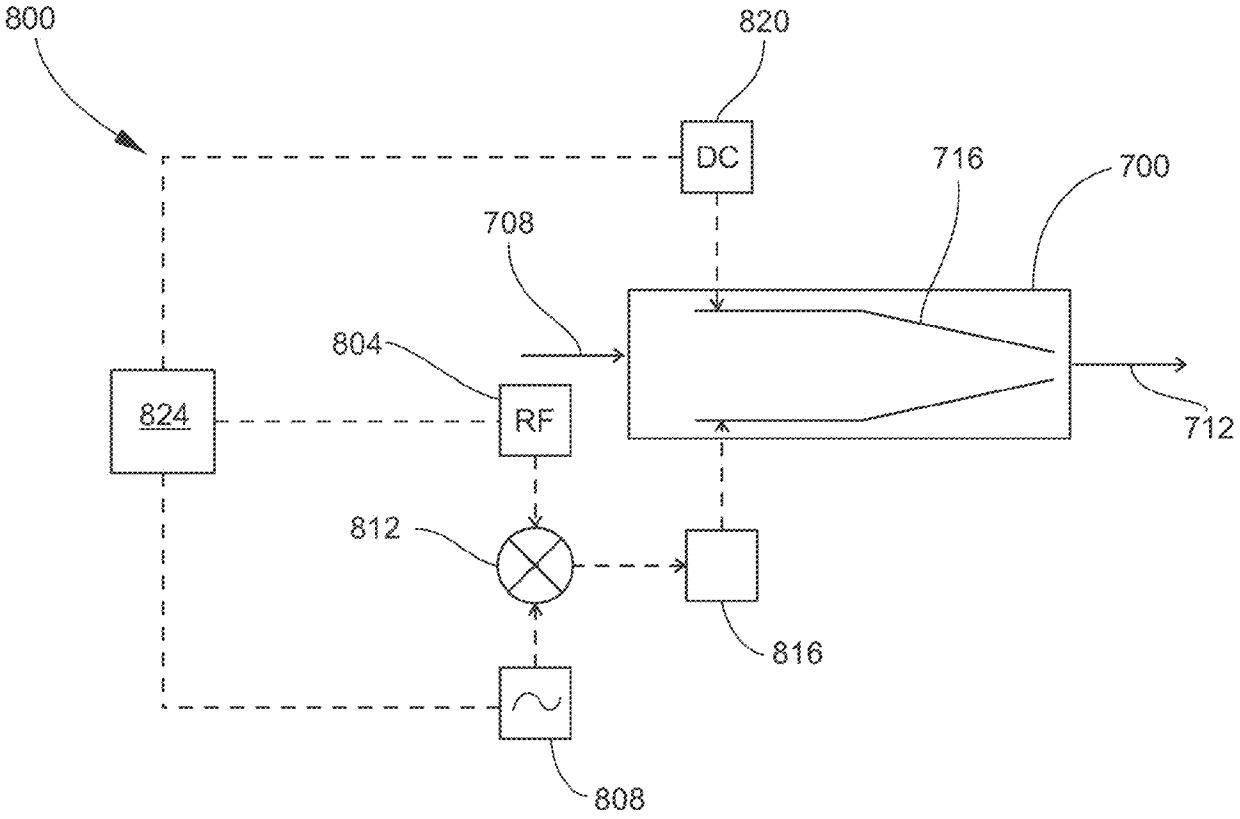
FIG. 8 is a high-level, simplified schematic view of an example of the ion guide and associated RF electronics.

FIG. 8 is a high-level, simplified schematic view of an example of the ion guide 700 and associated RF electronics (circuitry) 800 (or RF voltage source) communicating with the ion guide 700. The RF electronics 800 may include an RF signal source 804 configured for generating an RF source signal at a main frequency $f=\omega/2\pi$, a modulator 808 configured for generating modulating signal at a modulating frequency $f_m=\omega_m/2\pi$, a frequency mixer 812 configured for mixing or combining the RF source signal and the modulating signal (i.e., the RF source signal multiplying by the modulating signal), and post-mixing electronics 816 configured as needed for amplifying the output signals from the mixer 812, filtering out unneeded signals/frequencies from the output signals, and otherwise processing the output signals as need to produce the different RF drive signals to be applied to the ion guide electrodes 716, as appreciated by persons skilled in the art. FIG. 8 also illustrates a DC voltage source 820 communicating with the ion guide 700. FIG. 8 further illustrates a computing device (or controller) 824 configured for controlling the timing and operation of various components of the RF electronics 800 and DC voltage source 820, as well as components of a system in which the ion guide 700 operates such as a spectrometry system. The computing device 824 may include hardware (microprocessor, memory, etc.) and software components, as appreciated by persons skilled in the art. The computing device 824 may also schematically represent input and output devices that provide a user interface, such as a keyboard, mouse, readout or display device, etc.

In some embodiments, the frequency mixer 812 produces two output signals, $V_1 \propto V_0 \cos \omega_m t \cos \omega t$ and $V_2 \propto V_0 \sin \omega_m t \cos \omega t$. This may be accomplished in a number of different ways, for example by heterodyning the RF source signal and the modulating signal as schematically depicted in FIG. 8, whereby the output signals may be summed or differenced to produce the two signals $V_1$ and $V_2$. The two signals $V_1$ and $V_2$ may then be processed as needed to construct the desired RF drive signals to be applied to the ion guide electrodes 716. Typically, the modulating frequency $f_m=\omega_m/2\pi$ is substantially less than the main frequency $f=\omega/2\pi$, or $f_m \ll f$. For example, the main frequency f may be in a range from 500 kHz to 5 MHz, while the modulating frequency $f_m$ may be in a range from 10 kHz to 100 kHz. As another example, the modulating frequency $f_m$ may be 1/10 or less than 1/10 of the main frequency f.

Continuing with the example of four RF drive signals respectively applied to four ion guide electrodes 716 in each electrode set, the four RF drive signals may have the following waveforms, letting the amplitude of each be equal ($V_0$):

$$V_A=V_0\cos(\omega_m t)\cos(\omega t),\qquad \text{First RF drive signal:}$$

$$V_B=V_0\cos(\omega_m t-\pi/2)\cos(\omega t),\qquad \text{Second RF drive signal:}$$

$V_C = V_0 \cos(\omega_m t - \pi)\cos(\omega t)$, and Third RF drive signal:

$V_D = V_0 \cos(\omega_m t - 3\pi/2)\cos(\omega t)$, Fourth RF drive signal:

where in this example the phase of the modulating component of the first RF drive signal has been arbitrarily set at zero rads.

The resultant electrostatic potential near-axis for straight (i.e., non-converging and non-diverging) sections, is:

$$V = V_0 I_0(\tilde{R})\cos(\tilde{z} - \omega_m t)\cos \omega t.$$

Provided $f_m \ll f$, this produces an effective potential of:

$$V^*(R,z,t) = V_{trap}[I_1^2(\tilde{R})\cos^2(\tilde{z} - \omega_m t) + I_0^2(\tilde{R})\sin^2(\tilde{z} - \omega_m t)],$$

which forms a series of potential wells that move in the positive z direction. The analysis is more difficult for converging sections but the result is still a series of potential wells that move in the positive z direction.

The potential wells may move at a speed of $u = 4\delta f_m$ in the positive z direction, where $\delta$ is an axial spacing (e.g., center-to-center spacing) between adjacent electrodes. Thus, it is seen that not only can the moving potential wells be utilized to push ions out of the ion guide 700, but also the speed at which ions exit the funnel can be controlled, i.e., set or adjusted as selected by the user, such as by setting the modulating frequency $f_m$ to a desired level. As one non-limiting example, for a given electrode spacing $\delta$ and selected speed u that ion bunches are driven out from the ion guide 700, the modulating frequency $f_m$ may be expressed as:

$$f_m = 25 \text{ kHz} \left(\frac{\delta}{1 \text{ mm}}\right)^{-1} \left(\frac{u}{100 \text{ m/s}}\right).$$

The modulating frequency $f_m$ should be compared with a typical drive frequency of, for example, 1.5 MHz.

In addition, the dispersion or spread in ion velocities is small, in the sense that all ions leaving the ion guide leave at substantially the same speed. Also, the ions leave the well in bunches that are pulsed in time. These features have advantages for, e.g., TOF (time-of-flight) based MS.

Figure 9:
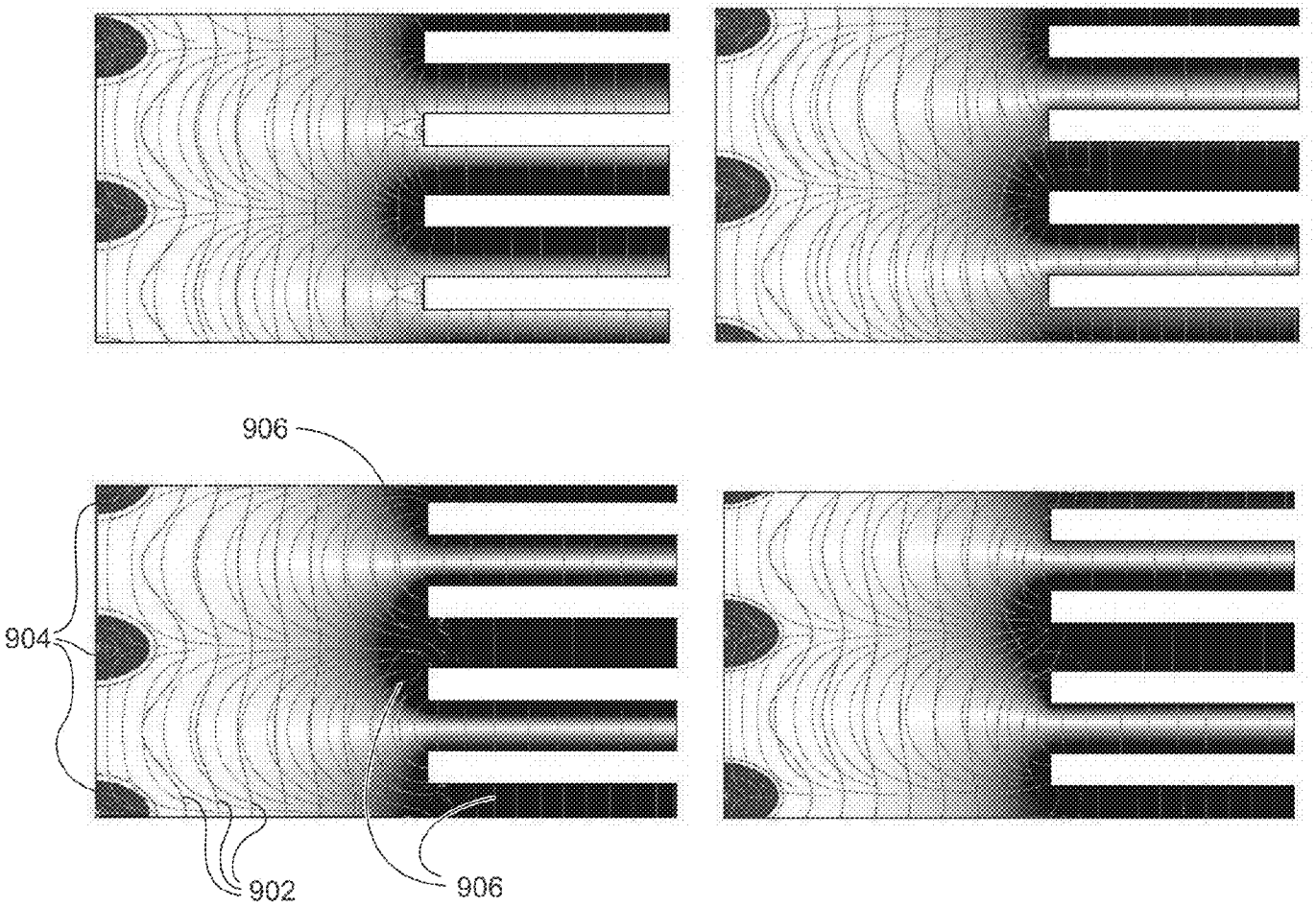
FIG. 9 illustrates a simulation of a straight section of an ion funnel.

FIG. 9 illustrates a simulation of a straight section of an ion funnel, in which each set of four electrodes are respectively driven by the four RF drive signals just described, $V_A = V_0 \cos(\omega_m t) \cos(\omega t)$, $V_B = V_0 \cos(\omega_m t - \pi/2) \cos(\omega t)$, $V_C = V_0 \cos(\omega_m t - \pi) \cos(\omega t)$, and $V_D = V_0 \cos(\omega_m t - 3\pi/2) \cos(\omega t)$. The contours of the effective potential are indicated at 902, the wells of the effective potential are indicated at 904, and the RF field lines are indicated at 906. The simulation is shown at four different phases: 0 rads (upper left), 0.35 rads (upper right), 0.70 rads (lower left), and 1.05 rads (lower right). It is seen that the wells gradually move up (+z) as a function of phase (i.e., time).

Figure 10:
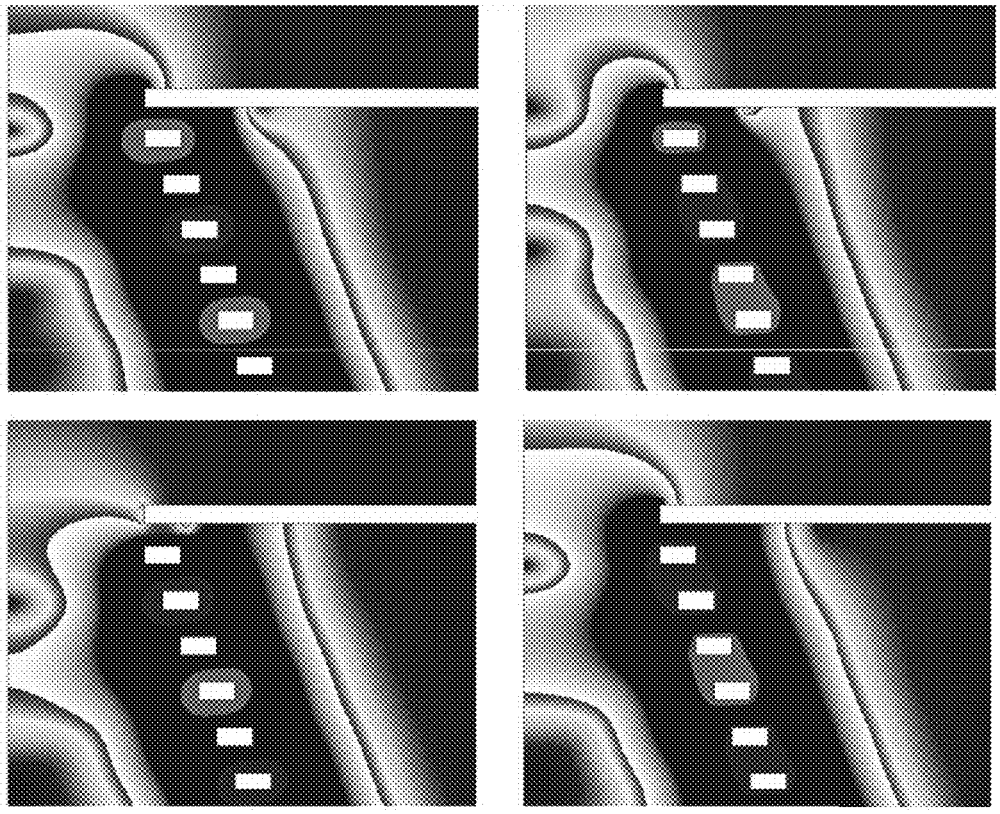
FIG. 10 illustrates a simulation of a converging section of an ion funnel.
Figure 11A:
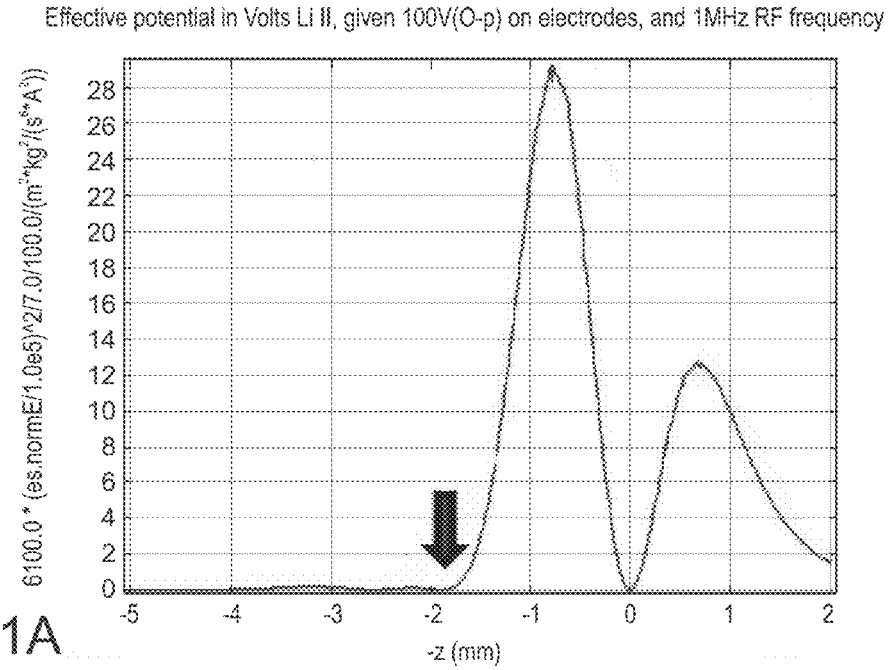
FIGS. 11A to 11F are plots of effective potential on-axis as a function of axial position for a singly-ionized lithium ion (Li II) in an ion funnel.
Figure 11B:
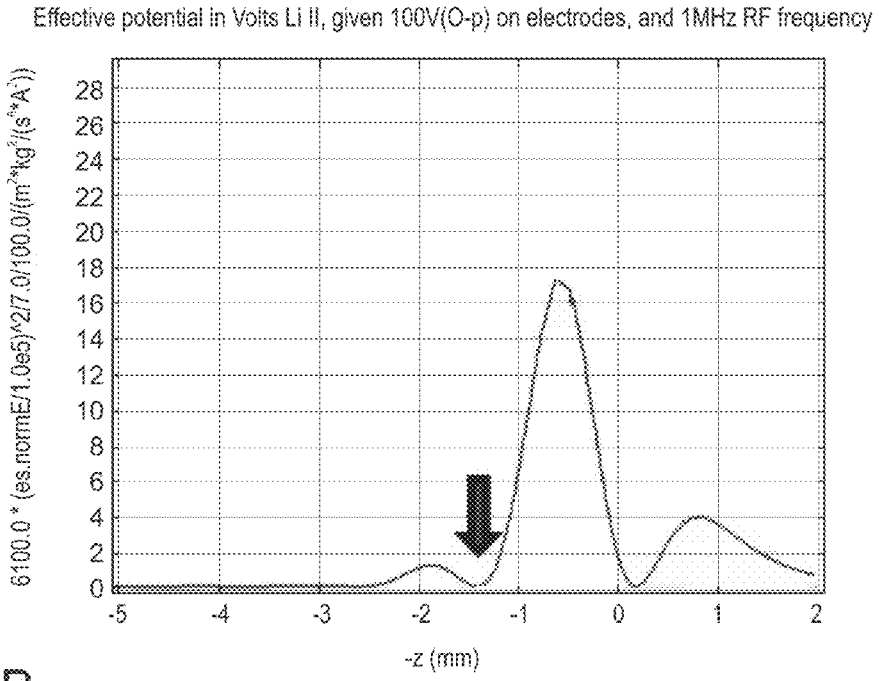
Figure 11C:
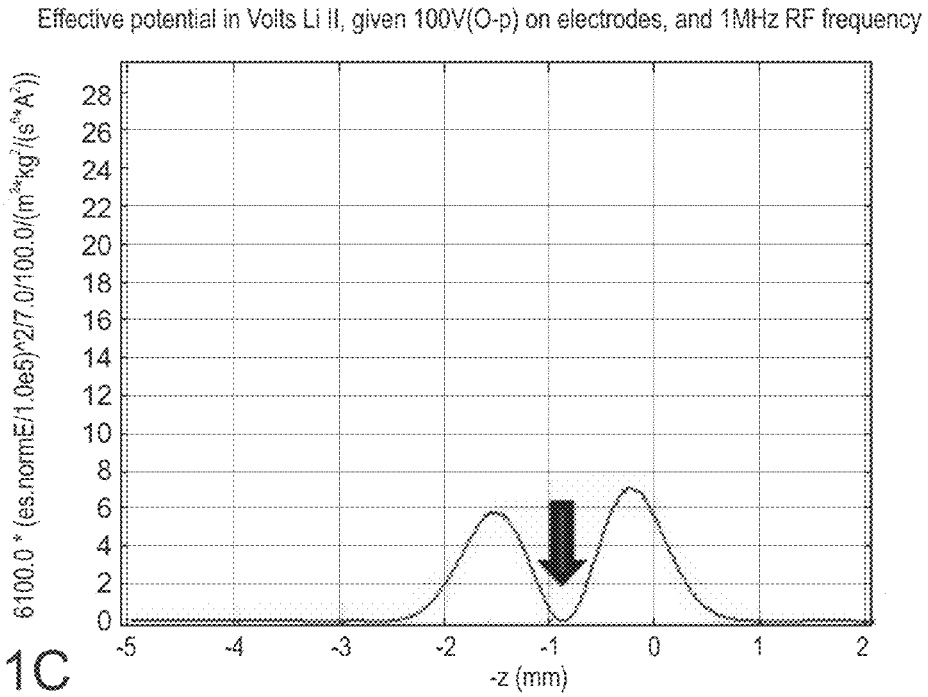
Figure 11D:
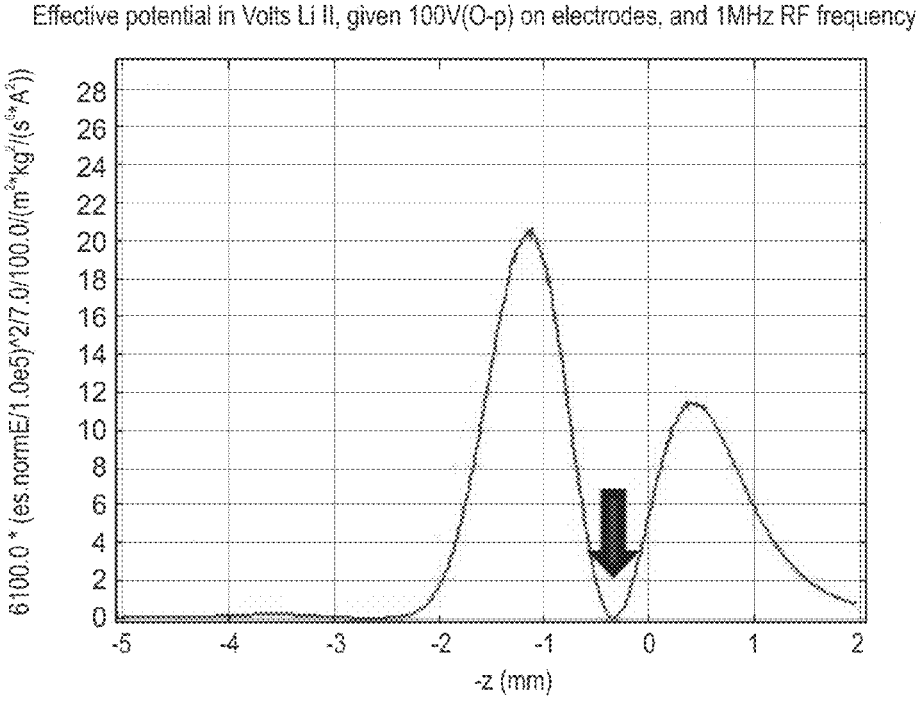
Figure 11E:
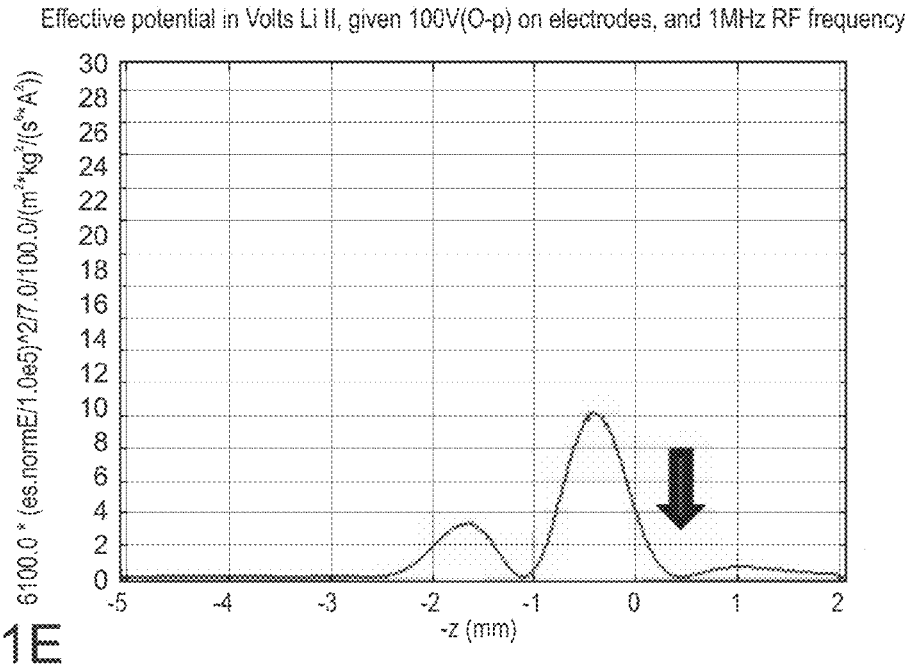
Figure 11F:
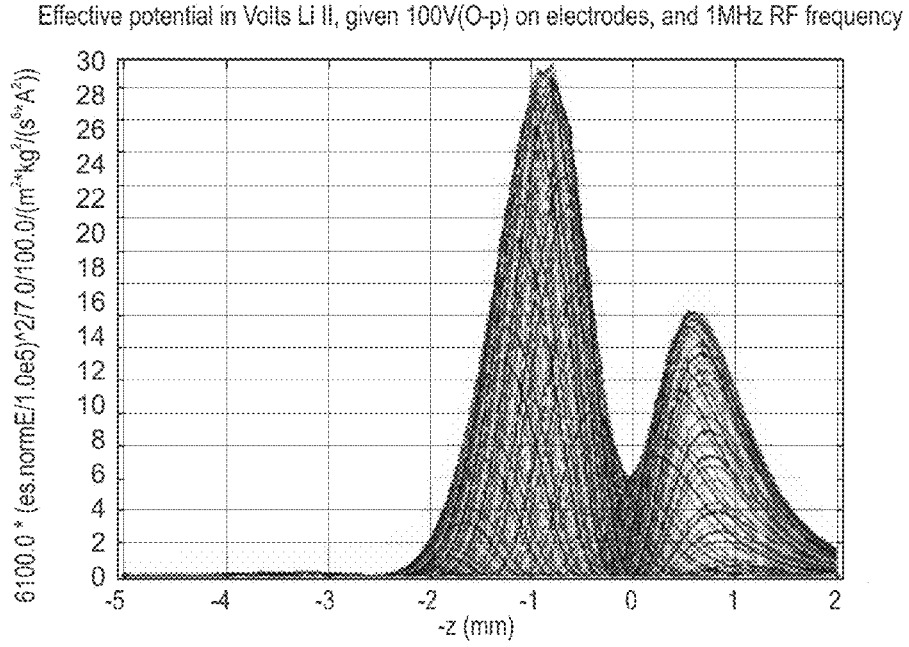
Figure 12A:
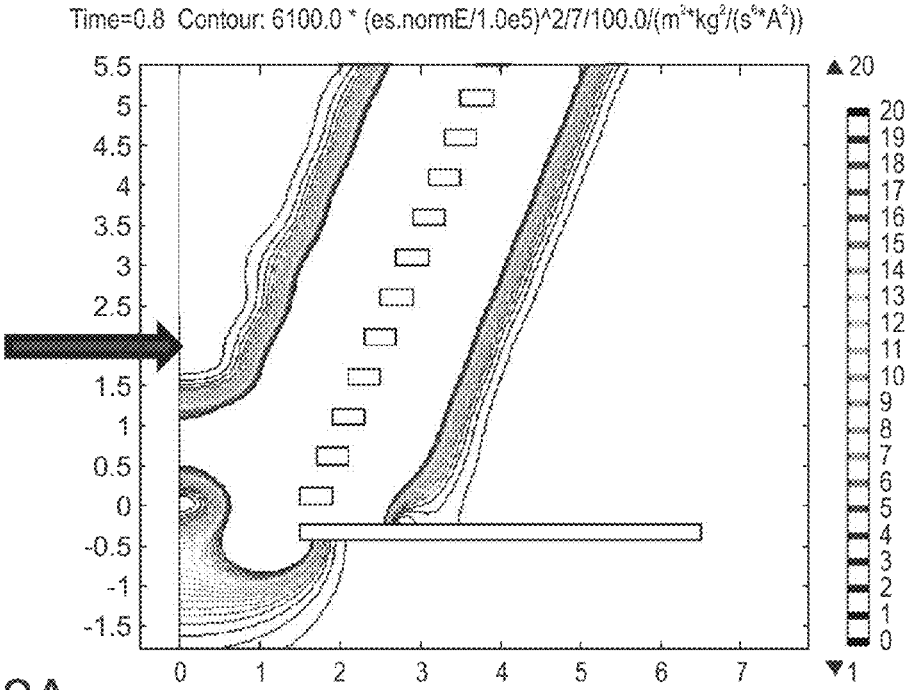
FIGS. 12A to 12D are two-dimensional contour plots of the effective potential for the Li II ion measured in volts.
Figure 12B:
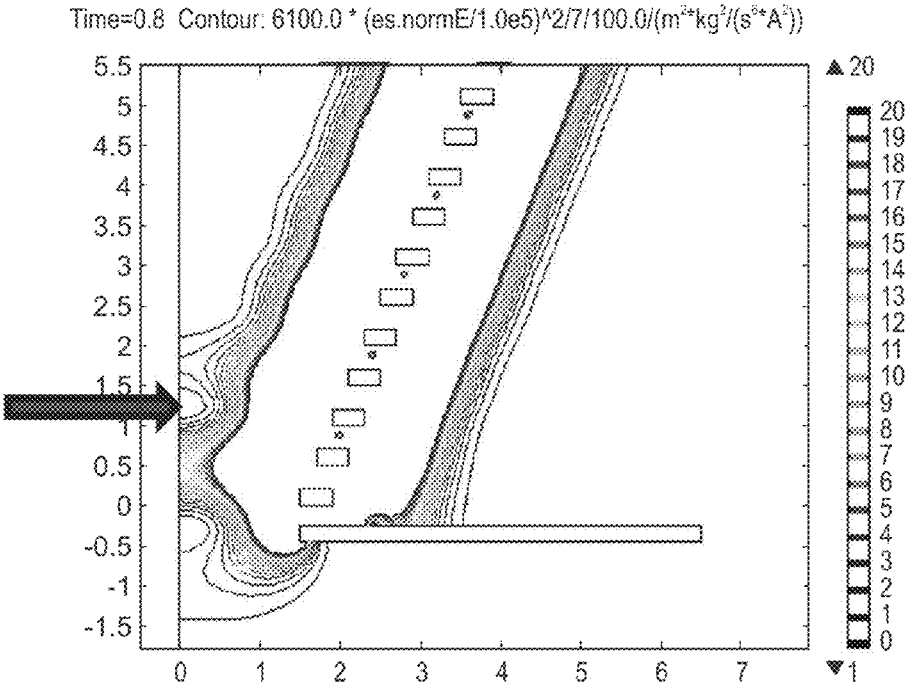
Figure 12C:
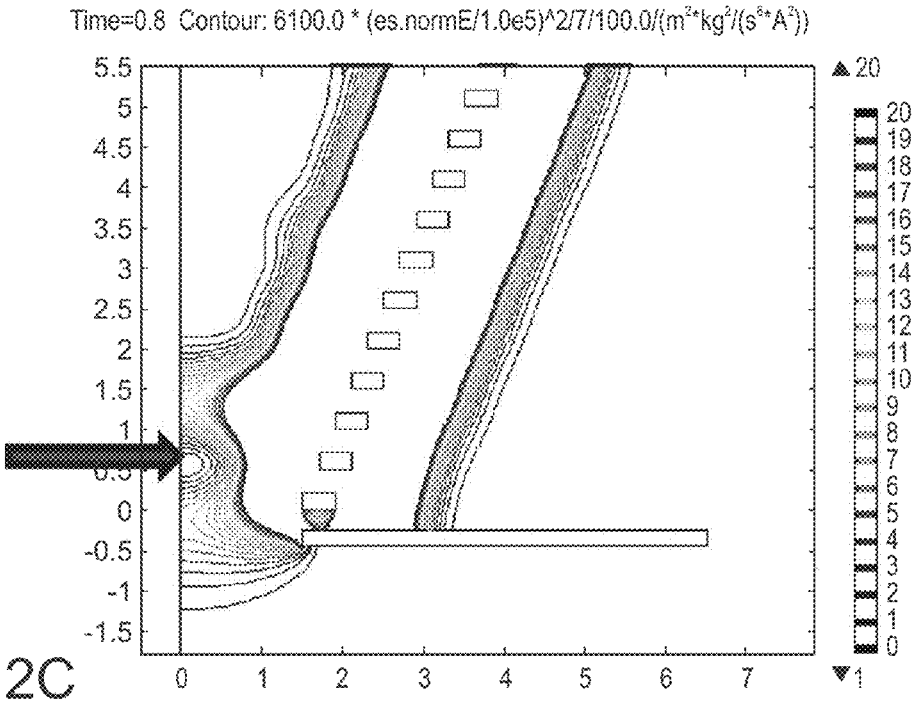
Figure 12D:
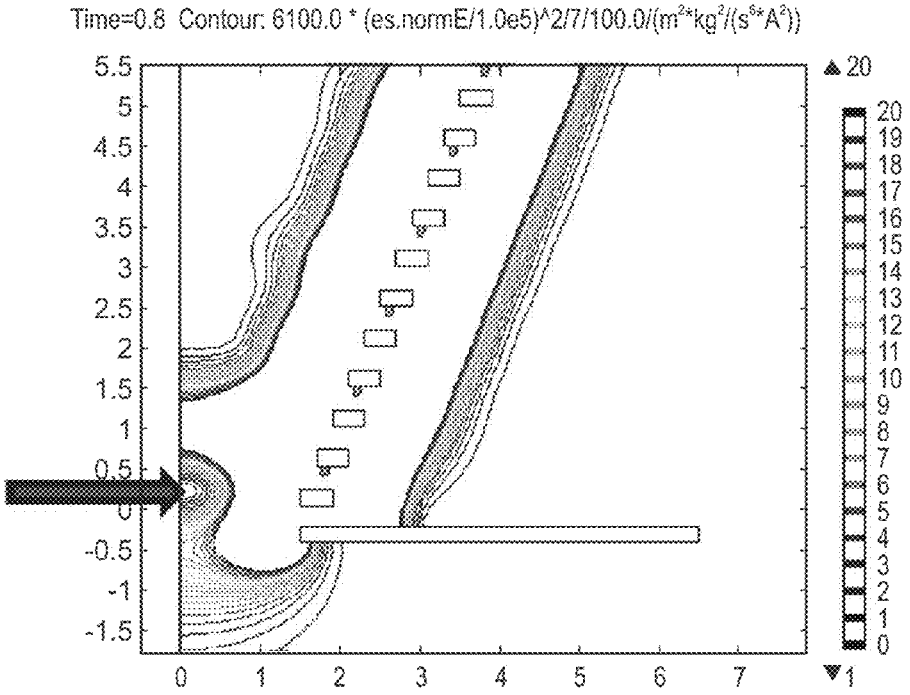

FIG. 10 illustrates a simulation of a converging section of an ion funnel, again driven by the four RF drive signals $V_A$, $V_B$, $V_C$, and $V_D$. The simulation is shown at four different phases, starting from the upper left and progressing to the upper right, the lower left, and the lower right. The interior of the funnel is rainbow-colored (i.e., differently shaded in the black and white representation of FIG. 10), corresponding to the strength of the electric field |E| (in V/m) and thus corresponding to the strength of the effective potential, which is proportional to the square of |E| as noted above. The darkest regions correspond to larger values where $|E| > 10^4$ V/m. In addition, individual plates (or rings) are color-coded according to the RF voltages on them. The colors are red (lighter shade) and blue (darker shade), depending on the RF phase. That is, red is 180 degrees out of phase with blue (at the main driving frequency f of about 1 MHz). As can be seen, each 180 phase shift in the modulating signal corresponds to an ejection of a bound region from the ion funnel. At no point in time (or phase) is there ever a clear path along a zero through the funnel, but rather a series of zeros move monotonically forward (upward) through the funnel.

FIGS. 11A to 11F are a set of plots of effective potential on-axis as a function of axial position for a singly-ionized lithium ion (Li II) in an ion funnel, according to a simulation in which the amplitude of the RF drive voltage was 100 V (0–p) and main RF drive frequency was 1 MHz. FIG. 11 includes plots corresponding to five different time slices (starting at the upper left), and an additional plot (lower right) showing the envelope of all time slices/phases. One can follow an individual well (red arrow) traveling through the ion funnel and being ejected out from the exit end. The bottom of this well remains at 0 V (within the numerical resolution of the simulation). Even though the neighboring peaks of the effective potential vary over time between a few volts to about 30 volts, there remains a traveling region a few 100 μm long along the axis where the effective potential never exceeds a few 100 mV.

FIGS. 12A to 12D are a set of two-dimensional contour plots of the effective potential for the Li II ion measured in volts, for the same fiducial quantities as specified above regarding FIG. 11, at four different times. The contour plots are "upside-down" such that the positive axial direction points downward and ions exit at the bottom. Again, one can see in this sequence how a small well with zero effective potential is "dripped" off the reservoir inside the funnel. Also noted is how steep the walls of the effective potential are; the lowest contour is drawn at 1V, and the highest at 20V.

As described above, the ion guide electrodes 716 (FIG. 7) may be divided (grouped) into an axial series of electrode groups or sets that begin at the ion entrance end 708 and terminate at the ion exit end 712, and the traveling potential wells are realized by applying a sequence of different RF waveforms to the respective ion guide electrodes 716 in a given electrode set. This may be done for all electrode sets over the entire length of the ion guide 700. That is, a repeating sequence of different RF waveforms may be applied to successive sets of the ion guide electrodes 716 from the ion entrance end 708 to the ion exit end 712, as described above. In other embodiments, however, the sequence of different RF waveforms may be applied to one or more of the electrode sets, but less than all of the electrode sets. When applying the sequence of different RF waveforms to more than one electrode set, the electrode sets to which the sequence is applied may be adjacent to each other, or alternatively may be separated by one or more electrode sets to which the sequence is not applied.

More generally, the sequence of different RF waveforms may be applied to at least one of the electrode sets of the ion guide 700. In some embodiments, the traveling potential well is found to be most useful in the section of the ion guide 700 near and at the ion exit end 712. Hence, in some embodiments, the sequence of different RF waveforms is applied to at least the electrode set at the ion exit end 712, i.e., the electrode set that includes (or terminates at) the ion exit end 712.

A conventional RF voltage may be applied to an electrode set to which the sequence of different RF waveforms as taught herein is not applied. For example, an RF voltage may be applied to such electrode set that is phase shifted by 180 degrees ($\pi$ rads) from one electrode to the next.

In some embodiments, the ion guide electrodes 716 may be divided (grouped) into a plurality of electrode groups or sets such that one or more of the electrode sets contain a different number of electrodes than the other electrode sets. For example, the ion guide 700 may include one or more first electrode sets each containing L electrodes (a first number of electrodes), one or more second electrode sets each containing M electrodes (a second number of electrodes), and one or more third electrode sets each containing N electrodes (a third number of electrodes), where $L \neq M$, $L \neq N$, and $M \neq N$. In this case, different RF waveform(s) may be applied to different electrode groups (groups containing different numbers of electrodes). As one non-limiting example, in a case where L=3 electrodes, M=4 electrodes, and N=8 electrodes, a sequence of RF waveforms may be applied to the respective electrodes of the first electrode set(s) in which the RF waveforms are progressively phase-shifted by 120 degrees from one electrode to the next, a sequence of RF waveforms may be applied to the respective electrodes of the second electrode set(s) in which the RF waveforms are progressively phase-shifted by 90 degrees from one electrode to the next, and a sequence of RF waveforms may be applied to the respective electrodes of the third electrode in which the RF waveforms are progressively phase-shifted by 45 degrees from one electrode to the next. The ion guide electrodes 716 may be arranged into different combinations of differently sized electrode groups as needed for tailoring the resulting traveling potential well configuration as desired.

According to other embodiments, a traveling well ion conduit/funnel as described herein may also be operated in such a way that the effective potential governing ion motion is time-averaged to approximate an axially smooth trough with a non-zero "line" minimum at r=0 (on-axis). This condition occurs when the modulation frequency $f_m$ is comparable to, or larger than, the secular ion oscillation frequency associated with the instantaneous potential well shape. If the wells are scanned sufficiently fast, the potential the ions experience becomes smoothed out ("blurred") axially, as compared to the "conveyor belt" mode described above. Alternatively, when the characteristic size of the potential well is similar to the spacing between adjacent wells, this condition is approximately equivalent to requiring that the axial velocity, u, of the travelling potential wells exceeds the average oscillation velocity of an ion confined in a potential well.

According to other embodiments, a spectrometer (or spectrometry system) is provided that includes at least one ion guide configured according at least one of the embodiments disclosed herein. For example, the ion guide may configured for creating travelling potential wells, and may include one or more straight and/or converging geometries, as described above. The spectrometry system may include an ion source, an ion guide downstream from the ion source, one or more ion analyzers downstream and/or upstream from the ion guide (or ion analyzers upstream of and downstream from the ion guide), and at least one ion detector operatively associated with the ion analyzer (or final ion analyzer). In some embodiments, the spectrometry system may be or include a mass spectrometer (MS), in which case at least one of the ion analyzers is a mass analyzer. In other embodiments, the spectrometry system may be or include an ion mobility spectrometer (IMS), in which case at least one of the ion analyzers is an IM drift cell. A traveling well ion guide as disclosed herein may be utilized as an IM drift cell. In other embodiments, the spectrometry system may be a hybrid IM-MS system that includes at least one IM drift cell and at least one MS (typically downstream of the IM drift cell).

Figure 13:
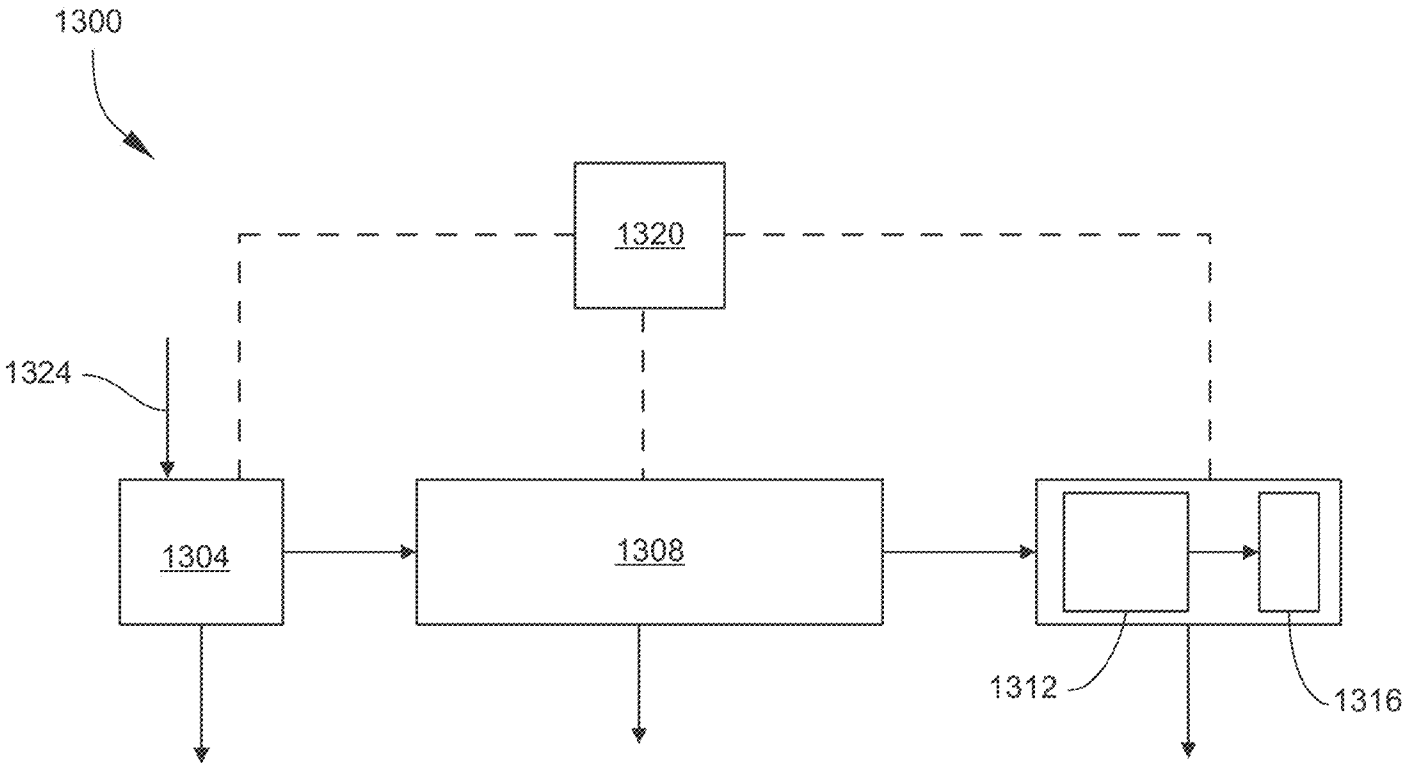
FIG. 13 is a schematic view of an example of a mass spectrometer (MS) or mass spectrometry (MS) system according to some embodiments.

FIG. 13 is a schematic view of an example of a mass spectrometer (MS) or mass spectrometry (MS) system 1300 according to some embodiments, which may include one or more ion guides as described herein. The operation and design of various components of mass spectrometry systems are generally known to persons skilled in the art and thus need not be described in detail herein. Instead, certain components are briefly described to facilitate an understanding of the subject matter presently disclosed.

The MS system 1300 may generally include, in serial order of ion process flow, an ion source 1304, an ion processing section 1308, a mass analyzer 1312, an ion detector 1316, and a computing device (or system controller) 1320. From the perspective of FIG. 13, overall ion travel through the MS system 1300 is in the direction from left to right as schematically depicted by horizontal arrows. The MS system 1300 also includes a vacuum system for maintaining various interior chambers of the MS system 1300 at controlled, sub-atmospheric pressure levels. The vacuum system is schematically depicted by downward pointing arrows that represent vacuum lines communicating with vacuum or exhaust ports of the chambers, one or more vacuum-generating pumps and associated components appreciated by persons skilled in the art. The vacuum lines may also remove residual non-analytical neutral molecules from the ion path through the MS system 1300.

The ion source 1304 may be any type of continuous-beam or pulsed ion source suitable for producing analyte ions for spectrometry. Examples of ion sources 1304 include, but are not limited to, electron ionization (EI) sources, chemical ionization (CI) sources, photo-ionization (PI) sources, electrospray ionization (ESI) sources, atmospheric pressure chemical ionization (APCI) sources, atmospheric pressure photo-ionization (APPI) sources, field ionization (FI) sources, plasma or corona discharge sources, laser desorption ionization (LDI) sources, and matrix-assisted laser desorption ionization (MALDI) sources. In some embodiments, the ion source 1304 may include two or more ionization devices, which may be of the same type or different type. Depending on the type of ionization implemented, the ion source 1304 may reside in a vacuum chamber or may operate at or near atmospheric pressure. Sample material to be analyzed may be introduced to the ion source 1304 by any suitable means, including hyphenated techniques in which the sample material is an output 1324 of an analytical separation instrument such as, for example, a gas chromatography (GC) or liquid chromatography (LC) instrument (not shown).

The mass analyzer 1312 may generally be any device configured for separating analyte ions on the basis of their different mass-to-charge (m/z) ratios. Examples of mass analyzers include, but are not limited to, TOF analyzers, multipole electrode structures (e.g., quadrupole mass filters, linear ion traps, three-dimensional Paul traps, etc.), electrostatic traps (e.g. Kingdon, Knight and ORBITRAP® traps), and ion cyclotron resonance (ICR) or Penning traps such as utilized in Fourier transform ion cyclotron resonance mass spectrometry (FT-ICR or FTMS). The ion detector 1316 may be any device configured for collecting and measuring the flux (or current) of mass-discriminated ions outputted from the mass analyzer 1312. The ion detector 1316 may also be configured for transmitting ion measurement data to the computing device 1320. Examples of ion detectors include, but are not limited to, multi-channel detectors (e.g., micro-channel plate (MCP) detectors), electron multipliers, photomultipliers, image current detectors, and Faraday cups.

The ion processing section 1308 generally represents an interface (or an intermediate section or region) between the ion source 1304 and the mass analyzer 1312. Generally, the ion processing section 1308 may be considered as being configured for receiving the ions produced by the ion source 1304 and transmitting the ions to the mass analyzer 1312. The ion processing section 1308 may further be configured for performing various ion processing operations prior to transmission into the mass analyzer 1312. For these purposes, the ion processing section 1308 may include one or more components (structures, devices, regions, etc.) positioned between the ion source 1304 and the mass analyzer 1312. These components may serve various functions such as, for example, pressure reduction, neutral gas removal, ion beam focusing/guiding, ion filtering/selection, ion fragmentation, etc. The ion processing section 1308 may include a housing enclosing one or more chambers. Each chamber may provide an independently controlled pressure stage, while appropriately sized apertures are provided at the boundaries between adjacent chambers to define a pathway for ions to travel through the ion processing section 1308 from one chamber to the next chamber. Any of the chambers may include one or more ion guides, ion optics, etc. Any of the ion guides may be configured according to any of the embodiments disclosed herein. For example, an ion guide as disclosed herein may be positioned just downstream of the ion source 1304 to receive ions outputted from the ion source 1304.

In some embodiments the mass analyzer 1312 in combination with the ion processing section 1308 (or a portion thereof) may form a tandem MS (MS/MS or $MS^n$) system. As an example, the ion processing section 1308 may include a first mass analyzing stage followed by a fragmentation stage. The first mass analyzing stage may include a multipole ion guide, which may be configured as a (typically quadrupole) mass filter for selecting ions of a specific m/z ratio or m/z ratio range. The fragmentation stage may include another multipole ion guide, which may be configured as a non-mass-resolving, RF-only collision cell for producing fragment ions by collision-induced dissociation (CID) as appreciated by persons skilled in the art. The mass analyzer 1312 in the case functions as the second or final mass analyzing stage. Thus, in some embodiments the MS system 1300 may be considered as including a QqQ, qTOF, or QqTOF instrument.

In FIG. 13, the computing device 1320 may schematically represent one or more modules (or units, or components) configured for controlling, monitoring and/or timing various functional aspects of the MS system 1300 such as performed by, for example, the ion source 1304, one or more components of the ion processing section 1308, the mass analyzer 1312, and the ion detector 1316, as well as any vacuum pumps, ion optics, upstream LC or GC instrument, sample introduction device, etc., that may be provided in the MS system 1300 but not specifically shown in FIG. 13. One or more modules (or units, or components) may be, or be embodied in, for example, a desktop computer, laptop computer, portable computer, tablet computer, handheld computer, mobile computing device, personal digital assistant (PDA), smartphone, etc. The computing device 1320 may also schematically represent all voltage sources not specifically shown, as well as timing controllers, clocks, frequency/waveform generators and the like as needed for applying voltages to various components of the MS system 1300. In particular, the computing device 1320 may be configured for controlling the voltages applied to ion guides as disclosed herein. The computing device 1320 may also be configured for receiving the ion detection signals from the ion detector 1316 and performing tasks relating to data acquisition and signal analysis as necessary to generate chromatograms, drift spectra, and mass (m/z ratio) spectra characterizing the sample under analysis. The computing device 1320 may also be configured for providing and controlling a user interface that provides screen displays of spectrometric data and other data with which a user may interact. The computing device 1320 may include one or more reading devices on or in which a tangible computer-readable (machine-readable) medium may be loaded that includes instructions for performing all or part of any of the methods disclosed herein. For all such purposes, the computing device 1320 may be in signal communication with various components of the MS system 1300 via wired or wireless communication links (as partially represented, for example, by dashed lines in FIG. 13). Also for these purposes, the computing device 1320 may include one or more types of hardware, firmware and/or software, as well as one or more memories and databases.

It will be understood that the MS system 1300 just described may be re-configured as an IM system or an IM-MS system. In the case of an IM system, an IM drift cell may be substituted for the mass analyzer 1312. In the case of an IM-MS system, ion processing section 1308 may be or include an IM drift cell.

Exemplary Embodiments

Exemplary embodiments provided in accordance with the presently disclosed subject matter include, but are not limited to, the following:

1. An ion guide, comprising: an entrance end; an exit end at a distance from the entrance end along a guide axis; a plurality of electrodes surrounding a guide volume and axially spaced from each other along the guide axis from the entrance end to the exit end; and RF electronics configured for applying an RF drive signal to the electrodes effective for generating an RF field in the guide volume comprising a plurality of potential wells distributed along the guide axis, wherein the RF field comprises a waveform effective for moving the potential wells in at least one set of the electrodes in an axial direction toward the exit end.

2. The ion guide of embodiment 1, wherein the electrodes have respective inside diameters that are substantially constant along the guide axis from the entrance end to the exit end.

3. The ion guide of embodiment 1, wherein the electrodes have respective inside diameters that are successively reduced along the guide axis from the entrance end to the exit end, such that the electrodes surround a guide volume that converges in a direction toward the exit end.

4. The ion guide of embodiment 1, comprising a cylindrical section and a funnel section upstream or downstream of the cylindrical section, wherein: in the cylindrical section, the electrodes have respective inside diameters that are substantially constant along the guide axis; and in the funnel section, the electrodes have respective inside diameters that are successively reduced along the guide axis in a direction toward the exit end.

5. The ion guide of any of the preceding embodiments, wherein the plurality of electrodes comprises a plurality of electrode sets repeated in sequence along the guide axis; each electrode set comprises N electrodes where N=3 or greater; the RF electronics are configured for producing N different RF drive signals respectively comprising N different waveforms, each of the N different waveforms having a parameter whose value differs from the value of the parameter of the other waveforms; and the RF electronics are configured for applying the N different RF drive signals to the respective N electrodes of each electrode set, wherein the sequence in which the N different RF drive signals are applied is repeated from one electrode set to the next electrode set.

6. The ion guide of any of embodiments 1 to 4, wherein the at least one electrode set comprises N electrodes where N=3 or greater; the RF electronics are configured for producing N different RF drive signals respectively comprising N different waveforms, each of the N different waveforms having a parameter whose value differs from the value of the parameter of the other waveforms; and the RF electronics are configured for applying the N different RF drive signals to the respective N electrodes of the at least one electrode set.

7. The ion guide of any of embodiments 1 to 4, wherein the plurality of electrodes comprises a plurality of electrode sets repeated in sequence along the guide axis; each electrode set comprises N electrodes where N=3 or greater; the RF electronics are configured for producing N different RF drive signals respectively comprising N different waveforms, each of the N different waveforms having a parameter whose value differs from the value of the parameter of the other waveforms; and the RF electronics are configured for applying the N different RF drive signals to the respective N electrodes of each electrode set, wherein the sequence in which the N different RF drive signals are applied is repeated from one electrode set to the next electrode set.

8. The ion guide of any of embodiments 1 to 4, wherein the plurality of electrodes comprises a first electrode set comprising M electrodes where M=3 or greater, and a second electrode set comprising N electrodes where N=3 or greater and M≠N; the RF electronics are configured for producing a first set of M different RF drive signals respectively comprising M different waveforms, each of the M different waveforms having a parameter whose value differs from the value of the parameter of the other waveforms; the RF electronics are configured for producing a second set of N different RF drive signals respectively comprising N different waveforms, each of the N different waveforms having a parameter whose value differs from the value of the parameter of the other waveforms; and the RF electronics are configured for applying the M different RF drive signals to the respective M electrodes of each first electrode set, and for applying the N different RF drive signals to the respective N electrodes of each second electrode set.

9. The ion guide of any of embodiments 5 to 8, wherein the parameter is phase.

10. The ion guide of any of the preceding embodiments, wherein the at least one set of electrodes is located at the exit end.

11. The ion guide of any of embodiments 5 to 10, wherein the N different RF waveforms and/or M different waveforms have the form $V_i\ F(\omega_m t-\phi_i)\ \exp(j\omega t)$, where $V_i$ is a zero-to-peak amplitude, F is a complex function of its argument and is periodic with period $2\pi$, t is time, $\omega$ and $\omega_m$ are scalars, $\phi_i$ is a phase, and i is an integer from 1 to N, and wherein the phase $\phi_i$ differs for each of the N different RF waveforms, and $V_i$ may or may not differ for each of the N different RF waveforms.

12. The ion guide of embodiment 11, wherein: N=4; the N electrodes in each electrode set comprise, in sequence, a first electrode, a second electrode, a third electrode, and a fourth electrode; the different RF drive signals comprise a first RF drive signal of the form $V_1\ F(\omega_m t-\phi_1)\ \exp(j\omega t)$, a second RF drive signal of the form $V_2\ F(\omega_m t-\phi_2)\ \exp(j\omega t)$, a third RF drive signal of the form $V_3\ F(\omega_m t-\phi_3)\ \exp(j\omega t)$, and a fourth RF drive signal of the form $V_4\ F(\omega_m t-\phi_4)\ \exp(j\omega t)$, wherein $\phi_1$ is a first phase, $\phi_2$ is a second phase shifted 90 degrees relative to the first phase, $\phi_3$ is a third phase shifted 180 degrees relative to the first phase, and $\phi_4$ is a fourth phase shifted 270 degrees relative to the first phase; and the RF electronics are configured for applying the first RF drive signal to the first electrode of each electrode set, applying the second RF drive signal to the second electrode of each electrode set, applying the third RF drive signal to the third electrode of each electrode set, and applying the fourth RF drive signal to the fourth electrode of each electrode set.

13. The ion guide of embodiment 12, wherein the RF electronics are configured for producing the first RF drive signal, the second RF drive signal, the third RF drive signal, and the fourth RF drive signal by multiplying a main RF signal of frequency f with a modulating signal of frequency $f_m$ where $f_m$ is substantially less than f, wherein the first RF drive signal has the form $V_0 \cos(\omega_m t) \cos(\omega t)$, the second RF drive signal has the form $V_0 \cos(\omega_m t-\pi/2) \cos(\omega t)$, the third RF drive signal has the form $V_0 \cos(\omega_m t-\pi) \cos(\omega t)$, and the fourth RF drive signal has the form $V_0 \cos(\omega_m t-3\pi/2) \cos(\omega t)$.

14. The ion guide of any of embodiments 1 to 12, wherein the RF electronics are configured for producing the RF drive signal by multiplying a main RF signal of frequency f with a modulating signal of frequency $f_m$ where $f_m$ is substantially less than f.

15. The ion guide of embodiment 14, wherein the RF electronics are configured for adjusting the frequency $f_m$ of the modulating signal wherein a speed at which the potential wells move is adjustable.

16. The ion guide of embodiment 14 or 15, wherein the RF electronics are configured for adjusting the frequency $f_m$ of the modulating signal such that an effective potential of the RF field is time averaged to approximate a non-zero magnitude of the effective potential on the guide axis.

17. The ion guide of any of embodiments 1 to 14, wherein the RF electronics are configured for adjusting a speed at which the potential wells move.

18. The ion guide of embodiment 17, wherein the RF electronics are configured for adjusting the speed such that an effective potential of the RF field is time averaged to approximate a non-zero magnitude of the effective potential on the guide axis.

19. The ion guide of any of the preceding embodiments, wherein the electrodes are axially spaced from each other by a distance in a range from 0.5 mm to 2.0 mm.

20. A spectrometer, comprising: the ion guide of any of the preceding embodiments; and an ion detector.

21. The spectrometer of embodiment 20, comprising a component selected from the group consisting of: an ion source upstream of the ion guide; a mass analyzer downstream or upstream from the ion guide; an ion mobility drift cell downstream or upstream from the ion guide; an ion mobility drift cell comprising the ion guide; an RF voltage source configured for applying an RF voltage to the electrodes effective for generating the RF field; and a combination of two or more of the foregoing.

22. A method for guiding ions, the method comprising: transmitting ions through an ion guide comprising an entrance end, an exit end at a distance from the entrance end along a guide axis, and a plurality of electrodes surrounding a guide volume and axially spaced from each other along the guide axis from the entrance end to the exit end; and while transmitting the ions, applying an RF field to the ions comprising a plurality of potential wells distributed along the guide axis, wherein the RF field is applied by applying an RF drive signal to the electrodes that comprises a waveform effective for moving the potential wells in at least one set of the electrodes in an axial direction toward the exit end.

23. The method of embodiment 22, wherein: the plurality of electrodes comprises a plurality of electrode sets repeated in sequence along the guide axis; each electrode set comprises N electrodes where N=3 or greater; the RF drive signal comprises N different RF drive signals respectively comprising N different waveforms, each of the N different waveforms having a parameter whose value differs from the value of the parameter of the other waveforms; and applying the RF drive signal comprises applying the N different RF drive signals to the respective N electrodes of each electrode set, wherein the sequence in which the N different RF drive signals are applied is repeated from one electrode set to the next electrode set.

24. The method of embodiment 22, wherein the at least one electrode set comprises N electrodes where N=3 or greater; the RF electronics are configured for producing N different RF drive signals respectively comprising N different waveforms, each of the N different waveforms having a parameter whose value differs from the value of the parameter of the other waveforms; and the RF electronics are configured for applying the N different RF drive signals to the respective N electrodes of the at least one electrode set.

25. The method of embodiment 22, wherein the plurality of electrodes comprises a plurality of electrode sets repeated in sequence along the guide axis; each electrode set comprises N electrodes where N=3 or greater; the RF electronics are configured for producing N different RF drive signals respectively comprising N different waveforms, each of the N different waveforms having a parameter whose value differs from the value of the parameter of the other waveforms; and the RF electronics are configured for applying the N different RF drive signals to the respective N electrodes of each electrode set, wherein the sequence in which the N different RF drive signals are applied is repeated from one electrode set to the next electrode set.

26. The method of embodiment 22, wherein the plurality of electrodes comprises a first electrode set comprising M electrodes where M=3 or greater, and a second electrode set comprising N electrodes where N=3 or greater and $M \neq N$; the RF electronics are configured for producing a first set of M different RF drive signals respectively comprising M different waveforms, each of the M different waveforms having a parameter whose value differs from the value of the parameter of the other waveforms; the RF electronics are configured for producing a second set of N different RF drive signals respectively comprising N different waveforms, each of the N different waveforms having a parameter whose value differs from the value of the parameter of the other waveforms; and the RF electronics are configured for applying the M different RF drive signals to the respective M electrodes of each first electrode set, and for applying the N different RF drive signals to the respective N electrodes of each second electrode set.

27. The method of any of embodiments 23 to 26, wherein the parameter is phase.

28. The method of any of embodiments 22 to 27, wherein the at least one set of electrodes is located at the exit end.

29. The method of any of embodiments 23 to 28, wherein the N different RF waveforms and/or M different waveforms have the form $V_i\ F(\omega_m t-\phi_i)\ \exp(j\omega t)$, where $V_i$ is a zero-to-peak amplitude, F is a complex function of its argument and is periodic with period $2\pi$, $\omega$ and $\omega_m$ are scalars, t is time, $\phi_i$ is a phase, and i is an integer from 1 to N, and wherein the phase $\phi_i$ differs for each of the N different RF waveforms, and $V_i$ may or may not differ for each of the N different RF waveforms.

30. The method of embodiment 29, wherein: N=4; the N electrodes in each electrode set comprise, in sequence, a first electrode, a second electrode, a third electrode, and a fourth electrode; the different RF drive signals comprise a first RF drive signal of the form $V_1\ F(\omega_m t-\phi_1)\ \exp(j\omega t)$, a second RF drive signal of the form $V_2\ F(\omega_m t-\phi_2)\ \exp(j\omega t)$, a third RF drive signal of the form $V_3\ F(\omega_m t-\phi_3)\ \exp(j\omega t)$, and a fourth RF drive signal of the form $V_4\ F(\omega_m t-\phi_4)\ \exp(j\omega t)$, wherein $\phi_1$ is a first phase, $\phi_2$ is a second phase shifted 90 degrees relative to the first phase, $\phi_3$ is a third phase shifted 180 degrees relative to the first phase, and $\phi_4$ is a fourth phase shifted 270 degrees relative to the first phase; and applying the N different RF drive signals comprises applying the first RF drive signal to the first electrode of each electrode set, applying the second RF drive signal to the second electrode of each electrode set, applying the third RF drive signal to the third electrode of each electrode set, and applying the fourth RF drive signal to the fourth electrode of each electrode set.

31. The method of embodiment 30, comprising producing the first RF drive signal, the second RF drive signal, the third RF drive signal, and the fourth RF drive signal by multiplying a main RF signal of frequency f with a modulating signal of frequency $f_m$ where $f_m$ is substantially less than f, wherein the first RF drive signal has the form $V_0 \cos(\omega_m t) \cos(\omega t)$, the second RF drive signal has the form $V_0 \cos(\omega_m t-\pi/2) \cos(\omega t)$, the third RF drive signal has the form $V_0 \cos(\omega_m t-\pi) \cos(\omega t)$, and the fourth RF drive signal has the form $V_0 \cos(\omega_m t-3\pi/2) \cos(\omega t)$.

32. The method of any of embodiments 22 to 30, comprising producing the RF drive signal by multiplying a main RF signal of frequency f with a modulating signal of frequency $f_m$ where $f_m$ is substantially less than f.

33. The method of embodiment 32, wherein the potential wells move in the axial direction at a speed of $4\delta f_m$, where $\delta$ is an axial spacing between adjacent electrodes.

34. The method of embodiment 32 or 33, comprising setting the frequency $f_m$ of the modulating signal such that an effective potential of the RF field is time averaged to approximate a non-zero magnitude of the effective potential on the guide axis.

35. The method of any of embodiments 22 to 34, comprising setting a speed at which the potential wells move in the axial direction.

36. The method of embodiment 35, comprising setting the speed such that an effective potential of the RF field is time averaged to approximate a non-zero magnitude of the effective potential on the guide axis.

37. The method of embodiment 35 or 36, wherein applying the RF field comprises multiplying a main RF signal of frequency f with a modulating signal of frequency $f_m$ where $f_m$ is substantially less than f, and setting the speed comprises setting the frequency $f_m$.

38. The method of any of embodiments 31 to 37, wherein the modulating frequency $f_m$ is:

$$f_m = 25\ \text{kHz}\left(\frac{\delta}{1\ \text{mm}}\right)^{-1}\left(\frac{u}{100\ \text{m/s}}\right),$$

where δ is an axial spacing between adjacent electrodes, and u is a speed at which the potential wells move.

39. The method of any of embodiments 22 to 38, comprising applying the RF field such that ion beam is concentrated in a converging manner along at least a portion of the ion guide.

40. A spectrometer, configured for performing the method of any of embodiments 22 to 39.

It will be understood that the term "in signal communication," "in electrical communication," or the like, as used herein means that two or more systems, devices, components, modules, or sub-modules are capable of communicating with each other via signals that travel over some type of signal path. The signals may be communication, power, data, or energy signals, which may communicate information, power, or energy from a first system, device, component, module, or sub-module to a second system, device, component, module, or sub-module along a signal path between the first and second system, device, component, module, or sub-module. The signal paths may include physical, electrical, magnetic, electromagnetic, electrochemical, optical, wired, or wireless connections. The signal paths may also include additional systems, devices, components, modules, or sub-modules between the first and second system, device, component, module, or sub-module.

More generally, terms such as "communicate" and "in . . . communication with" (for example, a first component "communicates with" or "is in communication with" a second component) are used herein to indicate a structural, functional, mechanical, electrical, signal, optical, magnetic, electromagnetic, ionic or fluidic relationship between two or more components or elements. As such, the fact that one component is said to communicate with a second component is not intended to exclude the possibility that additional components may be present between, and/or operatively associated or engaged with, the first and second components.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. An ion guide, comprising:

an entrance end;

an exit end at a distance from the entrance end along a guide axis;

a plurality of electrodes surrounding a guide volume and axially spaced from each other along the guide axis from the entrance end to the exit end; and RF electronics configured for:

applying an RF drive signal to the electrodes effective for generating an RF field in the guide volume comprising a plurality of potential wells distributed along the guide axis, wherein the RF field comprises a waveform effective for moving the potential wells in at least one set of the electrodes in an axial direction toward the exit end; and setting a speed at which the potential wells move in the axial direction, such that an effective potential of the RF field is time averaged to approximate a non-zero magnitude of the effective potential on the guide axis.

2. The ion guide of claim 1, wherein the electrodes have a configuration selected from the group consisting of:

the electrodes have respective inside diameters that are substantially constant along the guide axis from the entrance end to the exit end;

the electrodes have respective inside diameters that are successively reduced along the guide axis from the entrance end to the exit end, such that the electrodes surround a guide volume that converges in a direction toward the exit end; and the ion guide comprises a cylindrical section and a funnel section upstream or downstream of the cylindrical section, wherein: in the cylindrical section, the electrodes have respective inside diameters that are substantially constant along the guide axis; and in the funnel section, the electrodes have respective inside diameters that are successively reduced along the guide axis in a direction toward the exit end.

3. The ion guide of claim 1, wherein:

the plurality of electrodes comprises a plurality of electrode sets repeated in sequence along the guide axis;

each electrode set comprises N electrodes where N=3 or greater;

the RF electronics are configured for producing N different RF drive signals respectively comprising N different waveforms, each of the N different waveforms having a parameter whose value differs from the value of the parameter of the other waveforms; and the RF electronics are configured for applying the N different RF drive signals to the respective N electrodes of each electrode set, wherein the sequence in which the N different RF drive signals are applied is repeated from one electrode set to the next electrode set.

4. The ion guide of claim 3, wherein the N different RF waveforms have the form $V_i\ F(\omega_m t-\phi_i)\ \exp(j\omega t)$, where $V_i$ is a zero-to-peak amplitude, F is a complex function of its argument and is periodic with period 2π, ω and $\omega_m$ are scalars, t is time, $\phi_i$ is a phase, and i is an integer from 1 to N, and wherein the phase $\phi_i$ differs for each of the N different RF waveforms.

5. The ion guide of claim 4, wherein:

N=4;

the N electrodes in each electrode set comprise, in sequence, a first electrode, a second electrode, a third electrode, and a fourth electrode;

the different RF drive signals comprise a first RF drive signal of the form $V_1\ F(\omega_m t-\phi_1)\ \exp(j\omega t)$, a second RF drive signal of the form $V_2\ F(\omega_m t-\phi_2)\ \exp(j\omega t)$, a third RF drive signal of the form $V_3\ F(\omega_m t-\phi_3)\ \exp(j\omega t)$, and a fourth RF drive signal of the form $V_4\ F(\omega_m t-\phi_4)\ \exp(j\omega t)$, wherein $\phi_1$ is a first phase, $\phi_2$ is a second phase shifted 90 degrees relative to the first phase, $\phi_3$ is a third phase shifted 180 degrees relative to the first phase, and $\phi_4$ is a fourth phase shifted 270 degrees relative to the first phase; and the RF electronics are configured for applying the first RF drive signal to the first electrode of each electrode set, applying the second RF drive signal to the second electrode of each electrode set, applying the third RF drive signal to the third electrode of each electrode set, and applying the fourth RF drive signal to the fourth electrode of each electrode set.

6. The ion guide of claim 5, wherein the RF electronics are configured for producing the first RF drive signal, the second RF drive signal, the third RF drive signal, and the fourth RF drive signal by multiplying a main RF signal of frequency f with a modulating signal of frequency $f_m$ where $f_m$ is substantially less than f, wherein the first RF drive signal has the form $V_0 \cos(\omega_m t) \cos(\omega t)$, the second RF drive signal has the form $V_0 \cos(\omega_m t-\pi/2) \cos(\omega t)$, the third RF drive signal has the form $V_0 \cos(\omega_m t-\pi) \cos(\omega t)$, and the fourth RF drive signal has the form $V_0 \cos(\omega_m t-3\pi/2) \cos(\omega t)$.

7. The ion guide of claim 1, wherein the RF electronics are configured for producing the RF drive signal by multiplying a main RF signal of frequency f with a modulating signal of frequency $f_m$ where $f_m$ is substantially less than f.

8. The ion guide of claim 1, wherein the RF electronics are configured for adjusting a speed at which the potential wells move.

9. The ion guide of claim 8, wherein the RF electronics are configured for adjusting the speed such that an effective potential of the RF field is time averaged to approximate a non-zero magnitude of the effective potential on the guide axis.

10. A spectrometer, comprising:

the ion guide of claim 1; and an ion detector downstream from the ion guide.

11. A method for guiding ions, the method comprising:

transmitting ions through an ion guide comprising an entrance end, an exit end at a distance from the entrance end along a guide axis, and a plurality of electrodes surrounding a guide volume and axially spaced from each other along the guide axis from the entrance end to the exit end;

while transmitting the ions, applying an RF field to the ions comprising a plurality of potential wells distributed along the guide axis, wherein the RF field is applied by applying an RF drive signal to the electrodes that comprises a waveform effective for moving the potential wells in at least one set of the electrodes in an axial direction toward the exit end; and setting a speed at which the potential wells move in the axial direction, such that an effective potential of the RF field is time averaged to approximate a non-zero magnitude of the effective potential on the guide axis.

12. The method of claim 11, wherein:

the plurality of electrodes comprises a plurality of electrode sets repeated in sequence along the guide axis;

each electrode set comprises N electrodes where N=3 or greater;

the RF drive signal comprises N different RF drive signals respectively comprising N different waveforms, each of the N different waveforms having a parameter whose value differs from the value of the parameter of the other waveforms; and applying the RF drive signal comprises applying the N different RF drive signals to the respective N electrodes of each electrode set, wherein the sequence in which the N different RF drive signals are applied is repeated from one electrode set to the next electrode set.

13. The method of claim 12, wherein the parameter is phase.

14. The method of claim 12, wherein the N different RF waveforms have the form $V_i F(\omega_m t-\phi_i) \exp(j\omega t)$, where $V_i$ is a zero-to-peak amplitude, F is a complex function of its argument and is periodic with period $2\pi$, $\omega$ and $\omega_m$ are scalars, t is time, $\phi_i$ is a phase, and i is an integer from 1 to N, and wherein the phase $\phi_i$ differs for each of the N different RF waveforms.

15. The method of claim 14, wherein:

N=4;

the N electrodes in each electrode set comprise, in sequence, a first electrode, a second electrode, a third electrode, and a fourth electrode;

the different RF drive signals comprise a first RF drive signal of the form $V_1 F(\omega_m t-\phi_1) \exp(j\omega t)$, a second RF drive signal of the form $V_2 F(\omega_m t-\phi_2) \exp(j\omega t)$, a third RF drive signal of the form $V_3 F(\omega_m t-\phi_3) \exp(j\omega t)$, and a fourth RF drive signal of the form $V_4 F(\omega_m t-\phi_4) \exp(j\omega t)$, wherein $\phi_1$ is a first phase, $\phi_2$ is a second phase shifted 90 degrees relative to the first phase, $\phi_3$ is a third phase shifted 180 degrees relative to the first phase, and $\phi_4$ is a fourth phase shifted 270 degrees relative to the first phase; and applying the N different RF drive signals comprises applying the first RF drive signal to the first electrode of each electrode set, applying the second RF drive signal to the second electrode of each electrode set, applying the third RF drive signal to the third electrode of each electrode set, and applying the fourth RF drive signal to the fourth electrode of each electrode set.

16. The method of claim 15, comprising producing the first RF drive signal, the second RF drive signal, the third RF drive signal, and the fourth RF drive signal by multiplying a main RF signal of frequency f with a modulating signal of frequency $f_m$ where $f_m$ is substantially less than f, wherein the first RF drive signal has the form $V_0 \cos(\omega_m t) \cos(\omega t)$, the second RF drive signal has the form $V_0 \cos(\omega_m t-\pi/2) \cos(\omega t)$, the third RF drive signal has the form $V_0 \cos(\omega_m t-\pi) \cos(\omega t)$, and the fourth RF drive signal has the form $V_0 \cos(\omega_m t-3\pi/2) \cos(\omega t)$.

17. The method of claim 11, comprising producing the RF drive signal by multiplying a main RF signal of frequency f with a modulating signal of frequency $f_m$ where $f_m$ is substantially less than f.

18. The method of claim 11, wherein applying the RF field comprises multiplying a main RF signal of frequency f with a modulating signal of frequency $f_m$ where $f_m$ is substantially less than f, and setting the speed comprises setting the frequency $f_m$.

19. The ion guide of claim 1, wherein the RF electronics are configured for multiplying a main RF signal of frequency f with a modulating signal of frequency $f_m$ where $f_m$ is substantially less than f, and setting the speed comprises setting the frequency $f_m$.

* * * * *